US006376453B1

(12) United States Patent
Kubota et al.

(10) Patent No.: US 6,376,453 B1
(45) Date of Patent: Apr. 23, 2002

(54) DETERGENT PARTICLES

(75) Inventors: Teruo Kubota; Hitoshi Takaya; Shu Yamaguchi; Hiroyuki Yamashita; Shuji Takana, all of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/355,032

(22) PCT Filed: Dec. 10, 1998

(86) PCT No.: PCT/JP98/05589

§ 371 Date: Jul. 22, 1999

§ 102(e) Date: Jul. 22, 1999

(87) PCT Pub. No.: WO99/29830

PCT Pub. Date: Jun. 17, 1999

(30) Foreign Application Priority Data

Dec. 10, 1997 (JP) ..... 9-340016
Jun. 22, 1998 (JP) ..... 10-175211

(51) Int. Cl.[7] ..... C11D 17/00; C11D 3/10; C11D 11/02

(52) U.S. Cl. ..... 510/438; 510/276; 510/361; 510/443; 510/452; 510/455; 510/509

(58) Field of Search ..... 510/276, 361, 510/438, 443, 452, 455, 509

(56) References Cited

U.S. PATENT DOCUMENTS

| | | | | | |
|---|---|---|---|---|---|
| 2,364,767 | A | * | 12/1944 | Zizinia et al. | 510/455 |
| 2,874,123 | A | * | 2/1959 | Schaafsma et al. | 510/455 |
| 3,177,147 | A | * | 4/1965 | Dugan | 510/455 |
| 3,423,321 | A | * | 1/1969 | Shaver | 510/455 |
| 3,454,499 | A | * | 7/1969 | Meyer et al. | 510/455 |
| 3,549,541 | A | * | 12/1970 | Reinish | 510/455 |
| 3,562,171 | A | * | 2/1971 | Guida | 510/455 |
| 3,579,299 | A | * | 5/1971 | Sams et al. | 510/455 |
| 3,674,700 | A | * | 7/1972 | Gaiser | 510/298 |
| 3,887,614 | A | * | 6/1975 | Susuki et al. | 510/455 |
| 3,926,827 | A | * | 12/1975 | Mangeli | 510/455 |
| 4,126,561 | A | * | 11/1978 | Barker | 510/519 |
| 4,406,808 | A | * | 9/1983 | Gangwisch et al. | 510/323 |
| 4,988,454 | A | * | 1/1991 | Eertink et al. | 510/443 |
| 5,024,778 | A | * | 6/1991 | Grecsek | 510/452 |
| 5,080,820 | A | * | 1/1992 | Grecsek | 510/562 |
| 5,139,693 | A | * | 8/1992 | Wilms et al. | 510/438 |
| 5,443,751 | A | * | 8/1995 | Mazzola | 510/349 |
| 6,284,722 | B1 | * | 9/2001 | Yamaguchi et al. | 510/357 |

FOREIGN PATENT DOCUMENTS

| | | | |
|---|---|---|---|
| JP | 3504734 | | 10/1991 |
| JP | A5125400 | | 5/1993 |
| JP | A5209200 | | 8/1993 |
| JP | A5247497 | | 9/1993 |
| JP | A873888 | | 3/1996 |
| JP | 09013097 | * | 1/1997 |
| JP | A9194878 | | 7/1997 |
| WO | WO-97/33970 A1 | * | 9/1997 |

* cited by examiner

*Primary Examiner*—Lorna M. Douyon
(74) *Attorney, Agent, or Firm*—Birch, Stewart, Kolasch & Birch, LLP

(57) ABSTRACT

To provide detergent particles having high-speed dissolution capable of dissolving quickly in water after supplying the detergent particles in water, and a method for preparing the detergent particles, and a detergent composition comprising the detergent particles. Detergent particles having an average particle size of from 150 to 500 μm and a bulk density of 500 g/liter or more, wherein the detergent particles comprising a detergent particle being capable of releasing a bubble from an inner portion of the detergent particles in a process of dissolving the detergent particle in water, the bubble having a size of one-tenth or more of a particle size of the detergent particle, and wherein the detergent particles have a dissolution rate as calculated by Equation (1) of 90% or more, under conditions where the detergent particles are supplied in water at 5° C.; stirred for 60 seconds under the test stirring conditions; and filtered with a standard sieve having a sieve-opening of 74 μm as defined by JIS Z 8801, or wherein the detergent particles have a dissolution rate of 82% or more, the detergent particles stirred for 30 seconds and calculated in the same manner as above.

38 Claims, 12 Drawing Sheets

DETERGENT PARTICLES

This application is the national phase under 35 U.S.C. §371 of PCT International Application No. PCT/JP98/05589 which has an International filing date of Dec. 10, 1998 which designated the United States of America.

TECHNICAL FIELD

The present invention relates to detergent particles having high-speed dissolubility and a method for preparing the same, and a detergent composition comprising the detergent particles.

BACKGROUND ART

Recently, in order to meet the consumers' need "to speedily finish laundry," the commercially available washing machines have the tendency of having large volumes, i.e. large amounts of laundry can be done at one time, and there is a mode of a short washing cycle for the washing time. In addition, in order to meet the consumers' need "to carefully wash the clothes," a gentle stirring cycle is arranged, thereby making it possible to reduce the clothes damaging. In addition, in order to meet environmental problems and energy-saving problems and have economic advantages, there are the trends for saving water, low-temperature washing and shortening of operation time.

All of these trends lead to decrease in the amount of work, which is a product of mechanical power and period of time, of the washing machines. As a result, the detergency is deteriorated owing to a decrease in the dissolution rate of the detergent particle, and the remaining insolubles of powdery detergents and the detergent particle remaining on clothes are increased at completion of washing cycle.

As a prior art in an attempt to solve these matters, Japanese Patent Laid-Open No. 5-247497 discloses a method of preparing a detergent composition having a high dissolubility, comprising, during the preparation of a crutcher slurry including zeolite, adding a citrate and spray-drying the mixture to obtain beads with improved strength, and applying a surfactant on the beads.

In addition, Japanese Unexamined Patent Publication No. 3-504734 discloses a granular adsorbent including 45 to 75% by weight of zeolite, 1 to 6% by weight of a soap, 1 to 12% by weight of a polymer, 0 to 25% by weight of sodium sulfate, 0 to 5% by weight of a nonionic surfactant, and 10 to 24% by weight of water, and supporting a surfactant by its high adsorption ability, wherein the granular adsorbent by which the surfactant is supported has a good distributive behavior into the washing machine.

However, in these publications, the above technological problems cannot be sufficiently solved, and in particular, these publications do not disclose a technology intending to prepare detergents which can dissolve at high speeds.

Therefore, as to typical powdery detergents which have been made commercially available, their dissolution rates after 60 seconds and 30 seconds supplying the powder detergent to water at 5° C. as defined in the present invention is measured by the method set forth in the present specification. As result, the dissolution rates after 60 seconds for detergents made commercially available in Japan, typical nine compact-type detergents, are in the range from 64 to 87%; the dissolution rates for detergents made commercially available in the U.S., typical four compact-type detergents, are in the range from 75 to 88%; the dissolution rates for detergents made commercially available in Europe, typical three compact-type detergents, are in the range from 57 to 70%; and the dissolution rates for detergents made commercially available in Asia and Oceania, typical two compact-type detergents, are in the range from 64 to 69%. And the dissolution rates after 30 seconds for detergents made commercially available in Japan, typical nine compact-type detergents, are in the range from 55 to 73%; the dissolution rates for detergents made commercially available in the U.S., typical four compact-type detergents, are in the range from 65 to 81%; the dissolution rates for detergents made commercially available in Europe, typical three compact-type detergents, are in the range from 40 to 60%; and the dissolution rates for detergents made commercially available in Asia and Oceania, typical two compact-type detergents, are in the range from 55 to 60%. The extent of the dissolution rates obtained above cannot be said to sufficiently meet the trends for demands in low-mechanical power mentioned above.

DISCLOSURE OF THE INVENTION

Accordingly, in order to meet the above problems, an object of the present invention is to provide detergent particles having high-speed dissolubility capable of dissolving quickly in water after supplying the detergent particles in water, and a method for preparing the detergent particles, and a detergent composition comprising the detergent particles.

The present invention pertains to the following:

[1] detergent particles having an average particle size of from 150 to 500 μm and a bulk density of 500 g/liter or more, wherein the detergent particles comprising a detergent particle being capable of releasing a bubble from an inner portion of the detergent particle in a process of dissolving the detergent particle in water, the bubble having a size of one-tenth or more of a particle size of the detergent particle, and wherein the detergent particles have a dissolution rate of 90% or more, under conditions where the detergent particles are supplied in water at 5° C.; stirred for 60 seconds under the stirring conditions (hereinafter simply referred to as "test stirring conditions") that 1 g of the detergent particles is supplied to a one-liter beaker having an inner diameter of 105 mm which is charged with one-liter of hard water having 71.2 mg $CaCO_3$/liter, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 μm as defined by JIS Z 8801, wherein the dissolution rate is calculated by Equation (1):

$$\text{Dissolution Rate (\%)}=[1-(T/S)]\times 100 \quad (1)$$

wherein S is a weight (g) of the detergent particles supplied; and T is a dry weight (g) of remaining insolubles of the detergent particles remaining on the sieve when a liquid prepared under the test stirring conditions is filtered with the sieve, wherein drying conditions for the remaining insolubles are keeping at a temperature of 105° C. for 1 hour, and then in a desiccator with a silica gel at 25° C. for 30 minutes, or wherein the detergent particles have a dissolution rate of 82% or more, as similarly calculated with stirring for 30 seconds;

[2] detergent particles having an average particle size of from 150 to 500 μm and a bulk density of 500 g/liter or more, wherein the detergent particles are a collective of a detergent particle comprising a base particle comprising a water-insoluble inorganic compound, a water-soluble polymer and a water-soluble salt, and a surfactant supported by the base particle, wherein the base particle has a localized structure in which larger portions of the water-soluble polymer and the water-soluble salt are present near the surface of the base particle rather than in the inner portion thereof, and wherein the detergent particles have a dissolution rate as calculated by Equation (1) of 90% or more, under conditions where the detergent particles are supplied in water at 5° C.; stirred for 60 seconds under the test stirring conditions; and filtered with a standard sieve having a sieve-opening of 74 μm as defined by JIS Z 8801, or wherein the detergent particles have a dissolution rate of 82% or more, as similarly calculated with stirring for 30 seconds;

[3] a method for preparing the detergent particles as defined in item [1] or item [2] above, comprising the steps of:

Step (a): preparing a slurry containing a water-insoluble inorganic compound, a water-soluble polymer, and a water-soluble salt, wherein 60% by weight or more of water-soluble components including the water-soluble polymer and the water-soluble salt is dissolved in the slurry;

Step (b): spray-drying the slurry obtained in Step (a) to prepare base particles; and Step (c): adding a surfactant to the base particles obtained in Step (b) to support the surfactant thereby;

[4] a detergent composition comprising the detergent particles as defined in item [1] or item [2] above in an amount of 50% by weight or more; and

[5] a detergent composition having an average particle size of from 150 to 500 μm and a bulk density of 500 g/liter or more, wherein the detergent composition comprising a detergent particle being capable of releasing a bubble from an inner portion of the detergent particle in a process of dissolving the detergent particle in water, the bubble having a size of one-tenth or more of a particle size of the detergent particle, and wherein the detergent composition has a dissolution rate as calculated by Equation (1) of 90% or more, under conditions where the detergent composition is supplied in water at 5° C.; stirred for 60 seconds under the test stirring conditions; and filtered with a standard sieve having a sieve-opening of 74 μm as defined by JIS Z 8801, or wherein the detergent composition has a dissolution rate of 82% or more, as similarly calculated with stirring for 30 seconds.

BEST MODE FOR CARRYING OUT THE INVENTION

Figure 1:
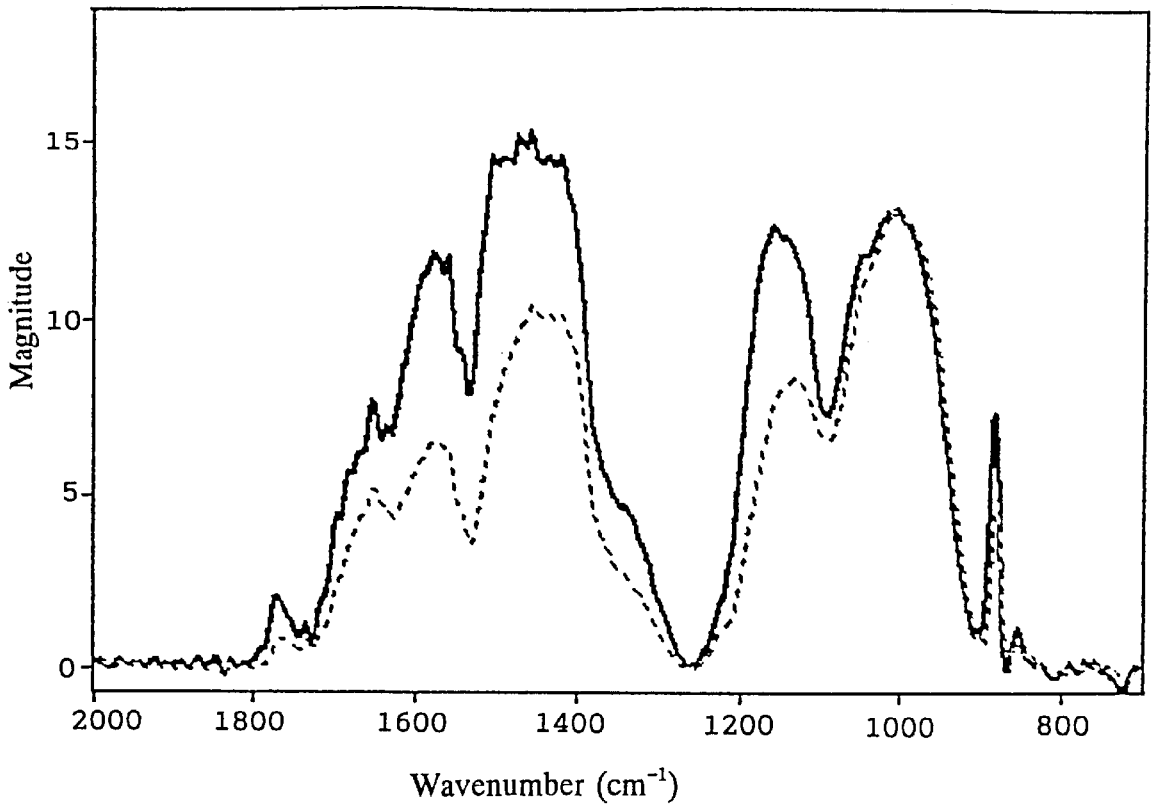
FIG. 1 is a graph showing comparative results of FT-IR/PAS measurements of Base Particles 1 retaining the original state and Base Particles 1 in a uniformly ground state, wherein the solid line indicates the data for the base particles retaining the original state, and the broken line indicates the data for the base particles in a uniformly ground state.
Figure 2:
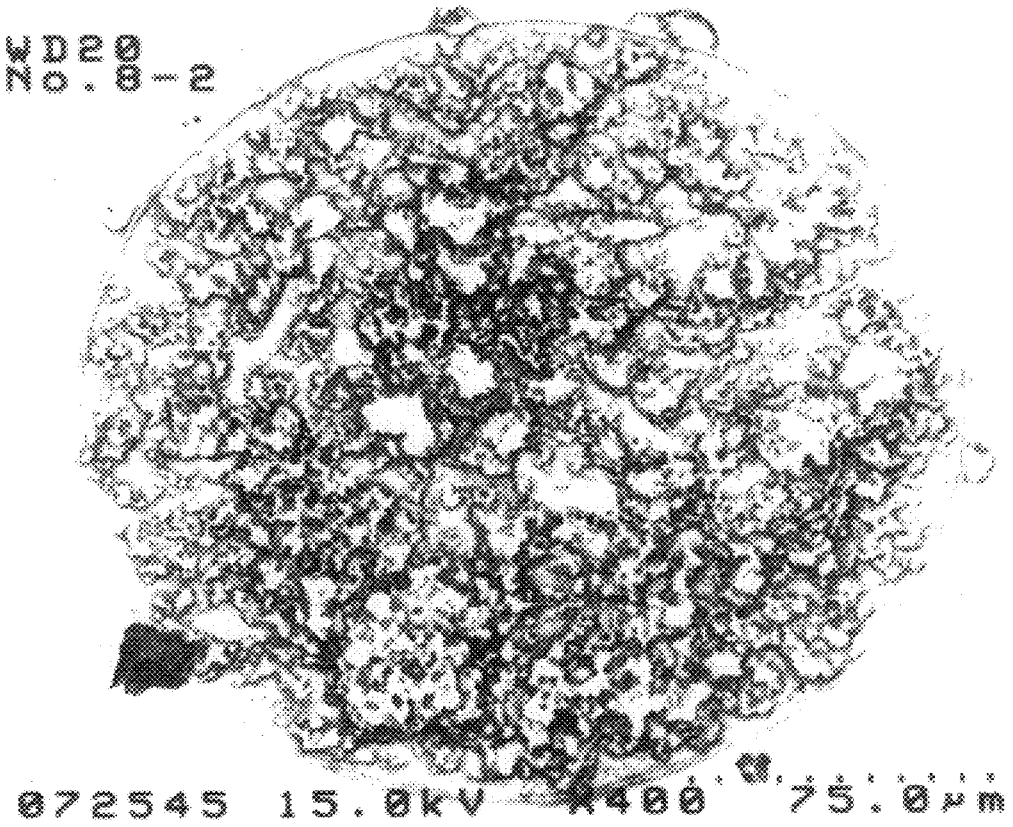
FIG. 2 is a photograph showing one example of a particle structure (magnification: ×400) of Base Particles 1 by SEM.
Figure 3:
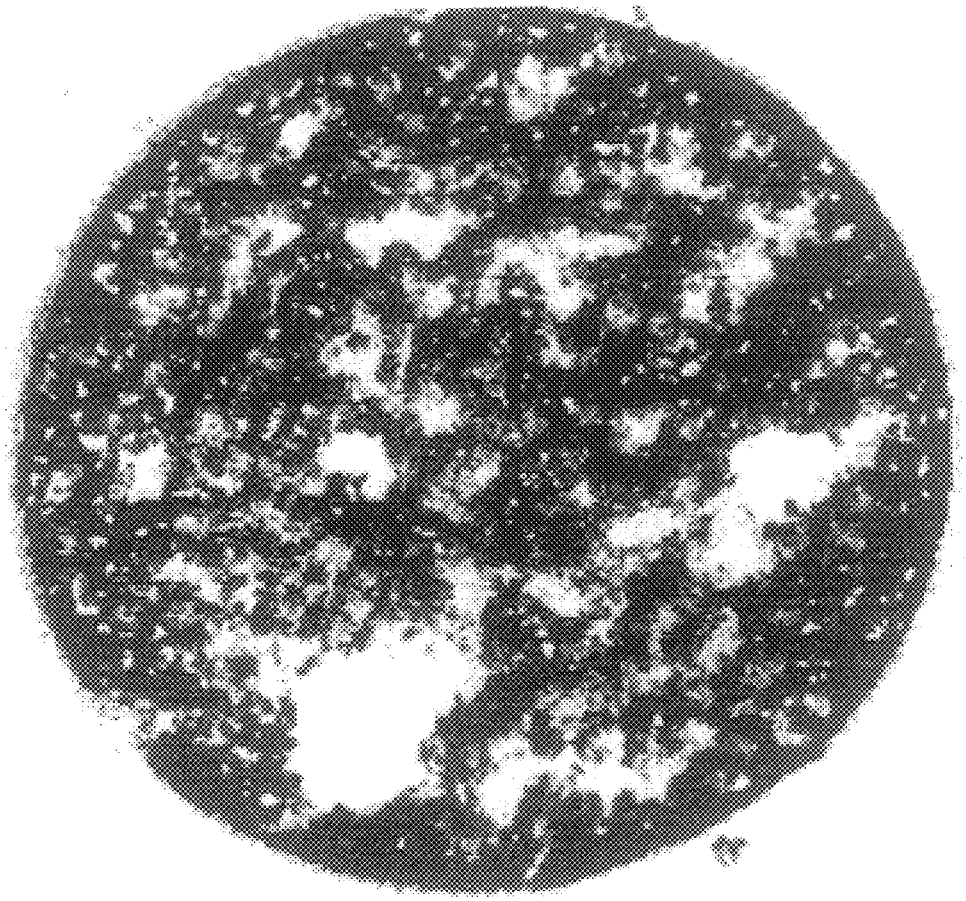
FIG. 3 is a photograph showing one example of a particle structure (magnification: ×400) of Base Particles 1 by EDS analysis (Na distribution).
Figure 4:
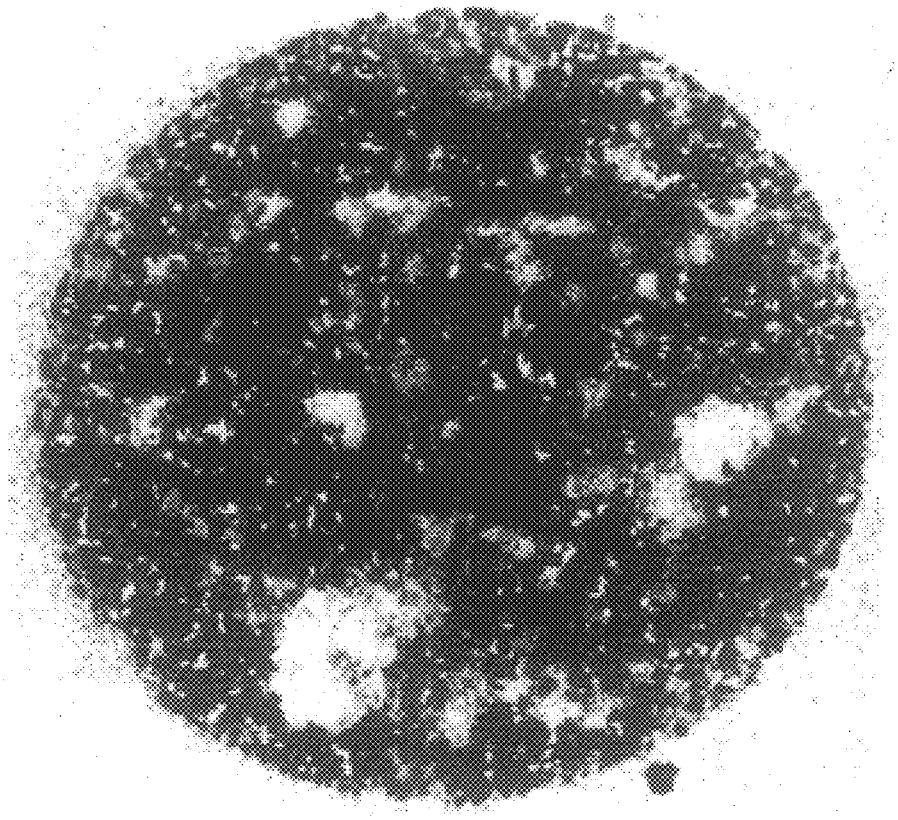
FIG. 4 is a photograph showing one example of a particle structure (magnification: ×400) of Base Particles 1 by EDS analysis (Al distribution).
Figure 5:
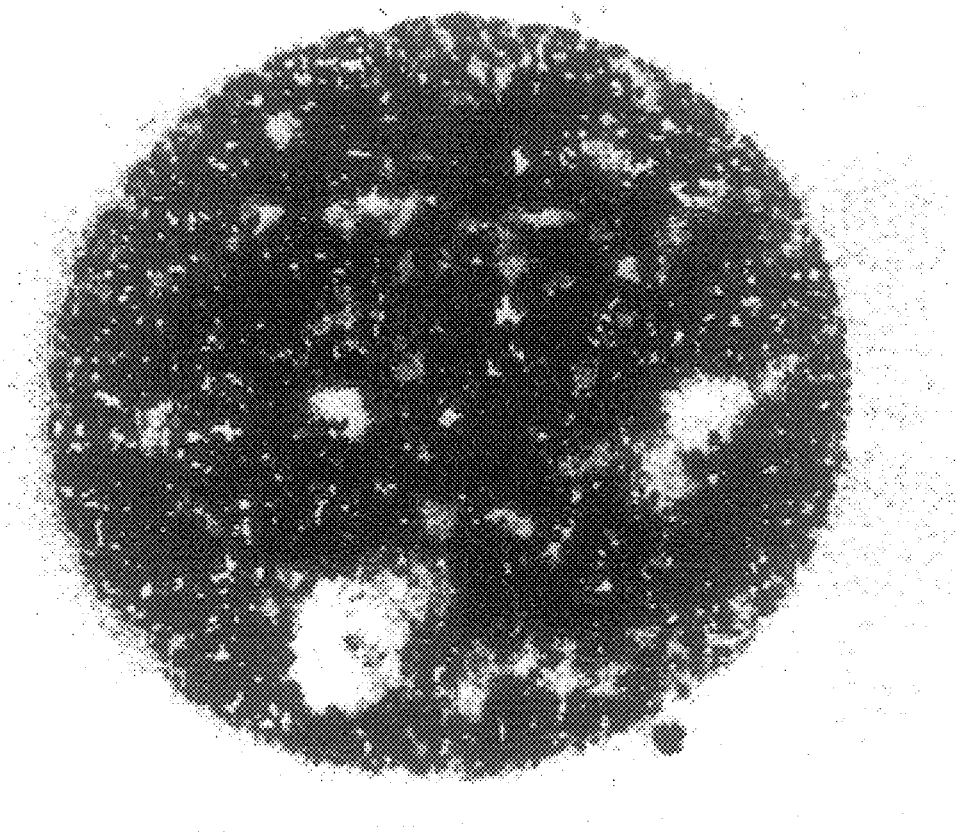
FIG. 5 is a photograph showing one example of a particle structure (magnification: ×400) of Base Particles 1 by EDS analysis (Si distribution).
Figure 6:
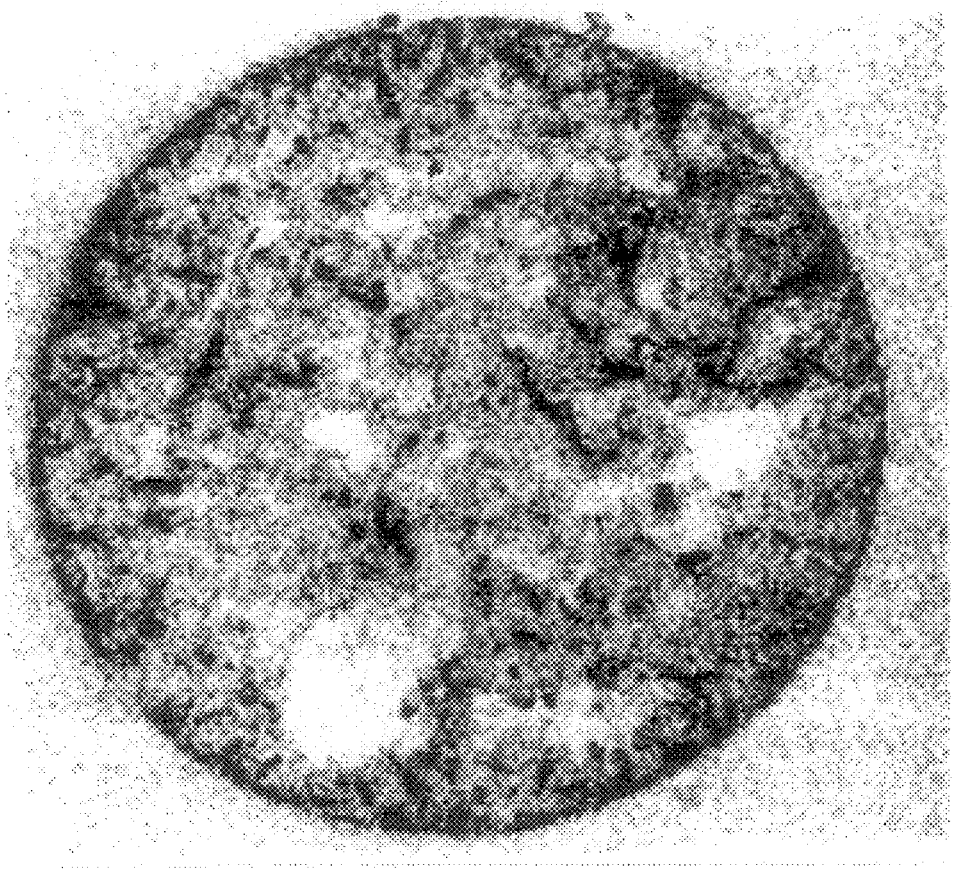
FIG. 6 is a photograph showing one example of a particle structure (magnification: ×400) of Base Particles 1 by EDS analysis (S distribution).

The detergent particle as referred to in the present invention is a particle comprising a surfactant, a builder, and the like, and the detergent particles mean a collective thereof. In addition, the detergent composition means a composition comprising the detergent particles, and further comprising separately added detergent components other than the detergent particles (for instance, fluorescent dyes, enzymes, perfumes, defoaming agents, bleaching agents, bleaching activators, and the like).

1. Mechanism of High-Speed Dissolubility 1.1 High-Speed Dissolubility by Releasing Bubble Conventional compact detergent particle requires a relatively longer period of time for complete dissolution because it shows dissolution behavior in which the detergent particle gradually dissolves from a portion near the surface of the detergent particle.

On the other hand, the detergent particles of the present invention comprise a detergent particle capable of releasing a bubble of one-tenth or more of the particle size of the detergent particle in a process in which the detergent particle is dissolved in water (hereinafter referred to as "bubble-releasing detergent particle"), and in a process in which the bubble-releasing detergent particle is dissolved in water, the bubble-releasing detergent particle firstly releases a bubble having a given size from the inner portion of the particle by allowing a small amount of water to enter into the inner portion thereof, and subsequently the particle itself undergoes breakdown (self-breakdown of the particle) by allowing of a large amount of water to enter into the inner portion of the particle, so that not only the dissolution takes place from a portion near the surface but also the dissolution and breakdown from the inner portion of the particle take place.

The dissolution behavior described above can be confirmed by a digital microscope or optical microscope as a phenomenon in which a bubble of one-tenth the size or more, preferably one-fifth or more, more preferably one-fourth or more, still more preferably one-third or more, of the particle size of the particle (hereinafter referred to as "bubble having a given size") is released in a case where the bubble-releasing detergent particle is dissolved in water. On the other hand, in the conventional compact detergent particle, most of the bubbles formed are of the size of less than one-tenth the size of the detergent particle, so that the particle itself does not undergo self-breakdown. Therefore, sufficient high-speed dissolubility cannot be obtained as in the case of the detergent particles of the present invention. Incidentally, it is preferable that in a case where the detergent particle is dissolved in water with a stand-still state, the bubble having a given size is generated within 120 seconds, more preferably within 60 seconds, still more preferably within 45 seconds.

The bubble-releasing detergent particle having high-speed dissolubility by releasing a bubble described above is not limited to specified ones as to the particle shapes and structures, as long as it has pores (which may be a single pore or a plurality of pores) which can release a bubble having a given size. For instance, it may be a uni-core detergent particle which is explained in Section 4., or it may be a detergent particle other than the uni-core detergent particle, including, for example, a detergent particle in which the uni-core base particle is agglomerated (hereinafter referred to as "multi-core detergent particle" as described in Sections 6. and 7.). In addition, it is preferable that the bubble-releasing detergent particle constitutes 60% by weight or more, more preferably 80% by weight or more, of the detergent particles.

The size of the bubble is measured as follows.

A double-sided adhesive tape is attached to a bottom center of a glass petri dish (inner diameter: 50 mm). Detergent particles are adhered to the double-sided adhesive tape. First, an equivalent diameter ($\alpha$ $\mu$m) for each of the detergent particles is calculated from an image obtained by a digital microscope. Examples of the digital microscope include "VH-6300" manufactured by KEYENCE CORPORATION.

Subsequently, 5 ml of ion-exchanged water at 20° C. was poured into the glass petri dish, and the dissolution behavior for the individual particles of the subject measurement is observed. When the bubble is released from the inner portion of the particle, the equivalent diameter ($\beta$ $\mu$m) of the bubble is measured from an image of an instant at which the bubble leaves from the particle. Incidentally, in a case where a plurality of bubbles are released from the inner portion of the particle, "$\beta$ $\mu$m" is referred to a maximum value of the equivalent diameter measured for each of the bubbles. The ratio of the bubble diameter to the particle size ($\beta/\alpha$) for each of the particles is calculated.

In a preferable bubble-releasing detergent particle, it is preferable that the pores having a size of one-tenth to four-fifth, preferably one-fifth to four-fifth, the particle size are present in the inner portion of the particle.

The size of the pores can be measured as follows.

The selected particle is split at a cross section so as to include the maximum particle size without crashing the particle with a surgical knife, or the like. The split cross section is observed by a scanning electron microscope (SEM). In a case where the equivalent diameter (particle size) [$\gamma$ $\mu$m] of a split cross section of the split particle and the presence of the pores in the inner portion of the particle are confirmed, an equivalent diameter of the pores (pore size) [$\delta$ $\mu$m] is measured. Incidentally, in a case where a plurality of pores are confirmed, the equivalent diameter $\delta$ $\mu$m is defined as the largest pore size among them. Thereafter, the ratio of the pore size to the particle size ($\delta/\gamma$) is calculated.

It is preferable that the bubble-releasing detergent particle has uni-core property, from the viewpoint of dramatically increasing the dissolution speed.

In addition, in a case where the bubble-releasing detergent particle is constituted by the base particle as described in Section 2. below, it is preferable that the base particle has a structure of having pores in the inner portion of the base particle, the pores having a size of one-tenth to four-fifth, preferably one-fifth to four-fifth, the particle size of the particle. The size of the pores can be measured in the same manner as that described above.

1.2 High-Speed Dissolubility by Localized Structure of Base Particle

In the detergent particle contained in the detergent particles of the present invention, apart from having the dissolution mechanism by releasing a bubble mentioned above, or in combination with the dissolution mechanism, high-speed dissolubility from the particle surface can be observed. The features thereof reside in that the detergent particle comprises a base particle comprising a water-insoluble inorganic compound, a water-soluble polymer and a water-soluble salt, and a surfactant supported by the base particle, wherein the base particle has such a localized structure (hereinafter simply referred to as "localized structure of the base particle") that a larger portion of the water-soluble polymer and the water-soluble salt is present near the surface of the base particle rather than in the inner portion thereof. The base particle in which a larger portion of the water-soluble substances is localized near the surface can exhibit high-speed dissolubility because the water-soluble components near the surface are more quickly dissolved in water, thereby showing a dissolution behavior in which the breakdown of the detergent particle from the particle surface is accelerated. Incidentally, the most preferable embodiment for exhibiting high-speed dissolubility is a detergent particle having the localized structure described above and further being the bubble-releasing detergent particle. In this case, the detergent particle includes not only the uni-core detergent particle but also the multi-core detergent particle. Incidentally, the definition of the uni-core detergent particle will be given in Section 4. described below. Also, the confirmation of the localized structure of the base particle will be given in Section 3. described below.

2. Composition of Base Particle

The base particle constituting the detergent particle contained in the detergent particles of the present invention comprises as main components (A) a water-insoluble inorganic compound, (B) a water-soluble polymer, and (C) a water-soluble salt, referring to a particle which can be used to support a surfactant, and a collective thereof is referred to as "base particles."

As the water-insoluble inorganic compound of (A) Component, those having a primary average particle size of from 0.1 to 20 $\mu$m are preferable. Examples thereof include crystalline or amorphous aluminosilicates, silicon dioxide, hydrated silicate compounds, clay compounds such as perlite and bentonite, and the like, among which crystalline or amorphous aluminosilicates, silicon dioxide and hydrated silicate compounds are favorably used. In particular, the crystalline aluminosilicates are preferable.

As the water-soluble polymer of (B) Component, there can be cited carboxylic acid-based polymers, carboxymethyl cellulose, water-soluble starches and sugars, among which the carboxylic acid-based polymers are preferable.

It is preferable to include carboxylic acid-based polymers such as a copolymer having a molecular weight of about several thousands to about 100,000 and represented by the following formula (I):

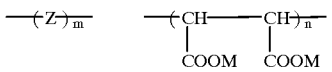

(I)

wherein Z is an olefin having 1 to 8 carbon atoms, acrylic acid, methacrylic acid, itaconic acid, methallylsulfonic acid, or the like, which is a monomer copolymerizable with maleic acid (anhydride) or a maleate; m and n take such values that a molecular weight of the copolymer is several hundreds to 100,000; and M is Na, K, $NH_4$, amine, or H; and/or a homopolymer having a molecular weight of about several thousands to about 100,000 represented by the formula (II):

(II)

wherein p is a homopolymerizable monomer, exemplified by acrylic acid, methacrylic acid, maleic acid, or the like; q takes a value such that the molecular weight of the resulting homopolymer is from several hundreds to 100,000, the homopolymer being in the form of an Na salt, a K salt, or an $NH_4$ salt.

Incidentally, the copolymer is generally prepared by random polymerization.

Among these carboxylic acid-based polymers, the salts of acrylic acid-maleic acid copolymers and the salts of polyacrylic acids (Na, K, $NH_4$, and the like) are particularly excellent. The molecular weight is preferably from 1,000 to 80,000, and the polymers having a molecular weight of 2,000 or more and a number of carboxyl groups of 10 or more are more preferable.

Besides the above carboxylic acid-based polymers, there can be used polymers such as polyglycidates or the like; cellulose derivatives such as carboxymethyl cellulose; aminocarboxylic acid-based polymers such as polyaspartates.

The amount of each of the copolymer of the formula (I) and/or the homopolymer of the formula (II) is preferably from 1 to 20% by weight, more preferably from 2 to 10% by weight in the detergent composition.

As the water-soluble salt of (C) Component, there can be included water-soluble inorganic salts typically exemplified by alkali metal salts, ammonium salts or amine salts of radicals such as carbonates, hydrogencarbonates, sulfates, sulfites, hydrogensulfates, phosphates, halides, or the like; and water-soluble organic acid salts having low-molecular weights such as citrates, fumarates, and the like. Among them, carbonates, sulfates, and sulfites are preferable. The inorganic salts are preferable because the pores in the detergent particle are further thermally expanded by causing hydration heat and dissolution heat by the reaction with water after preparation of the base particles, thereby accelerating the self-breakdown of the particle.

Here, sodium carbonate is preferable as an alkalizing agent showing a suitable pH buffer region in the washing liquid. The alkalizing agents other than sodium carbonate are amorphous or crystalline silicates. The amorphous silicate (water glass) has been widely used as an alkalizing agent in detergent starting materials. In a case where the aluminosilicate is used as a water-insoluble inorganic compound of the base particle, when the amorphous silicate (water glass) is included in the composition, hardly soluble, insoluble mass is likely to be formed, so that much care must be attended for the kinds and the amounts of the base materials.

The salts having high degree of dissociation, such as sodium sulfate, potassium sulfate, and sodium sulfite, have increased ionic strength of the washing liquid, thereby favorably acting to sebum stains washing, and the like. In addition, the sulfite is important in having the effects of reducing hypochlorite ions contained in tap water, thereby having an effect of preventing oxidation degradation of the detergent components such as enzymes and perfumes by the hypochlorite ions. Also, the use of sodium tripolyphosphate, which is a builder having excellent metal ion capturing ability and alkalizing ability, does not hinder the effects of the present invention. In addition, as the water-soluble organic salts having a low molecular weight, those base materials having a large $pKCa^{2+}$ and/or having a large cationic exchange capacity are preferable with expectation of imparting the metal ion capturing ability. Besides the citrates, there can be also cited methyliminodiacetates, iminodisuccinates, ethylenediaminedisuccinates, taurine diacetates, hydroxyethyliminodiacetates, β-alanine diacetate, hydroxyiminodisuccinates, methylglycine diacetate, glutamic acid diacetate, aspargine diacetate, serine diacetate, and the like. Here, from the viewpoint of detergency, taurine diacetates, hydroxyethyliminodiacetates, β-alanine diacetate, hydroxyiminodisuccinates, methylglycine diacetate, glutamic acid diacetate, aspargine diacetate, serine diacetate are preferable.

In addition, when anions other than carbonates, such as sulfates and sulfites, and cations other than sodium ions, such as potassium ions and ammonium ions, are mixed in the base particle, there is an effect in the anti-caking property. Also, similar effects can be also exhibited when adding an anionic surfactant such as an alkylbenzenesulfonate in an amount of 5 to 25% by weight.

The composition of the base particle is as follows. The water-insoluble inorganic compound of Component (A) is preferably from 20 to 90% by weight, more preferably from 30 to 75% by weight, most preferably from 40 to 70% by weight. The water-soluble polymer of Component (B) is preferably from 2 to 30% by weight, more preferably from 3 to 20% by weight, most preferably from 5 to 20% by weight. The water-soluble salts of Component (C) is preferably from 5 to 78% by weight, more preferably from 10 to 70% by weight, still more preferably from 10 to 67% by weight, particularly preferably from 20 to 60% by weight, most preferably from 20 to 55% by weight. Within the above ranges, the base particle is favorable in the aspects of having a structure in which near the surface of the base particle is coated with a water-soluble component, so that the coating layer is sufficiently formed on the particle surface, thereby making its particle strength sufficient. Also, it is preferable from the viewpoint of the dissolubility of the resulting detergent composition.

In addition, besides these three components (A) to (C), there may be included in the base particle, surfactants and other auxiliary components suitably used in detergent compositions, such as fluorescent dyes, pigments and dyes.

In order to obtain the desired particle strength and bulk density, although the surfactant is substantially not required as an essential component of the base particle, the surfactant may be added in a slurry prepared in Step (a) of Section 5. described below in order to improve the drying efficiency in Step (b). The amount of the surfactant in the slurry is preferably 10% by weight or less, more preferably from 1 to 10% by weight, most preferably from 2 to 8% by weight. Incidentally, the amounts are obtained on the basis of the solid components of the slurry.

Higher the supporting ability of the base particle, more likely the high-speed dissolubility is exhibited even when large amounts of the surfactant are added.

Examples of the factors for improving the supporting ability of the base particle include use of base materials having a large supporting ability (oil-absorbing ability) as the water-insoluble inorganic compounds of Component (A). An example of suitable base material is A-type zeolite which is preferable from the viewpoints of the metal ion capturing ability and economic advantages. Here, the A-type zeolite has an oil-absorbing ability measured by a method according to JIS K 5101 of from 40 to 50 mL/100 g (Examples thereof include trade name: "TOYOBUILDER," manufactured by Tosoh Corporation.). Besides the above, there can be cited P-type (for example, trade names: "Doucil A24" and "ZSE064" manufactured by Crosfield B.V.; oil-absorbing ability: 60 to 150 mL/100 g), and X-type (for example, trade name: "Wessalith XD" manufactured by Degussa-AG; oil-absorbing ability: 80 to 100 mL/100 g). In addition, amorphous silica and amorphous aluminosilicates having high oil-absorbing ability but low metal ion capturing ability can be used as water-insoluble inorganic compounds. Examples thereof include amorphous aluminosilicates disclosed in Japanese Patent Laid-Open No. 62-191417, page 2, lower right column, line 19 to page 5, upper left column, line 17 (particularly, it is preferable that the initial temperature is in the range from 15° to 60° C.); amorphous aluminosilicates disclosed in Japanese Patent Laid-Open No. 62-191419, page 2, lower right column, line 20 to page 5, lower left column, line 11 (particularly those having oil-absorbing ability of 170 mL/100 g are preferable); and amorphous aluminosilicates disclosed in Japanese Patent Laid-Open No. 9-132794, column 17, line 46 to column 18, line 38, Japanese Patent Laid-Open No. 7-10526, column 3, line 3 to column 5, line 9, Japanese Patent Laid-Open No. 6-227811, column 2, line 15 to column 5, line 2, and Japanese Patent Laid-Open No. 8-119622, column 2, line 18 to column 3, line 47 (oil-absorbing ability: 285 mL/100 g). For example, there can be used as an oil-absorbing carrier, "TOKSIL NR" (manufactured by Tokuyama Soda Co., Ltd.; oil-absorbing ability: 210 to 270 mL/100 g); "FLOWRITE" (the same as above; oil-absorbing ability: 400 to 600 mL/100 g); "TIXOLEX 25" (manufactured by Kofran Chemical; oil-absorbing ability: 220 to 270 mL/100 g); "SILOPURE" (manufactured by Fuji Devison Co., Ltd.; oil-absorbing ability: 240 to 280 mL/100 g), and the like. In particular, as the oil-absorbing carriers, favorable are those having properties described in Japanese Patent Laid-Open No. 5-5100, column 4, line 34 to column 6, line 16 (especially, the oil-absorbing carriers described in column 4, line 43 to 49); and Japanese Patent Laid-Open No. 6-179899, column 12, line 12 to column 13, line 17 and column 17, line 34 to column 19, line 17.

In the present invention, these water-insoluble inorganic compounds may be used alone or in combination of several kinds. Among them, from the viewpoint of maintaining high dissolubility even when stored for a long period of time (without undergoing property changes), it is preferable that aluminosilicates have an Si/Al (molar ratio) of 4.0 or less, preferably 3.3 or less.

3. Localized Structure of Base Particle

As a method for confirming the localized structure of the base particle, there can be employed, for instance, a combined method of Fourier transform infrared spectroscopy (FT-IR) and photoacoustic spectroscopy (PAS) (simply abbreviated as "FT-IR/PAS"). As described in "*APPLIED SPECTROSCOPY*," 47, 1311–1316 (1993)), the distribution state of the substances in the direction of depth from the surface of the samples can be confirmed by FT-IR/PAS.

The measurement method for determining the structure of the base particle used in the present invention will be exemplified below.

Each cell is charged with each base particle of two different states to conduct FT-IR/PAS measurement, and the structure of the base particle can be determined by comparing the measurement values. In other words, one FT-IR/PAS measurement is taken for the base particle in a state where the desired structure is retained, and another FT-IR/PAS measurement is taken for the comparative sample in which the base particle is in a uniform state by sufficiently grinding the base particle with an agate mortar. The FT-IR/PAS is measured, for instance, by using an infrared spectrometer "FTS-60A/896" (manufactured by Bio-Rad Laboratories), and the PAS cell includes an acoustic detector "Model 300" manufactured by MTEC Corporation. The measurement conditions are resolution of 8 $cm^{-1}$, scanning speed of 0.63 cm/s, and 128 scans. In the above measurement conditions, the information up to a depth of about 10 $\mu$m from the surface of the base particle is included. In the PAS spectra of the base particle, each of the characteristic peaks of sodium carbonate, sodium sulfate, zeolite and sodium polyacrylate can be read off at 1434 $cm^{-1}$ ($CO_3^{2-}$ degenerate stretching vibration), 1149 $cm^{-1}$ ($SO_4^{2-}$ degenerate stretching vibration), 1009 $cm^{-1}$ (Si—O—Si anti-symmetric stretching vibration), and 1576 $cm^{-1}$ ($CO_2^{-}$ anti-symmetric stretching vibration), respectively, and the areal intensity of each peak is measured. The relative areal intensity of each of the characteristic peaks of the water-soluble salts such as sodium carbonate or sodium sulfate to the characteristic peaks of the zeolite, when measured for each of the state in which the structure of the base particle is retained, and the state in which the base particle is uniformly ground, is obtained. The resulting relative intensity is then compared with the relative areal intensity of the characteristic peaks of the water-soluble polymer to the characteristic peaks of the zeolite, when measured for each of the above states, and thereby the structural features of the base particle can be determined. Concretely, it can be proven that the base particle has a localized structure such that larger portions of the water-soluble polymer and/or the water-soluble salts are included near the surface of the base particle than the inner portion thereof, and that a larger portion of the water-insoluble inorganic compound is included in the inner portion of the base particle than near the surface thereof.

With respect to the base particle, ratios of the relative areal intensity of the characteristic peaks of the water-soluble salts and the water-soluble polymer to the characteristic peaks of the zeolite when measured in the state in which the localized structure of the components is retained to the relative areal intensity of the characteristic peaks when measured in the state in which the base particle is ground to give a uniform state are calculated. As to the water-soluble salts, the ratio is 1.1 or more, preferably 1.3 or more, and as to the water-soluble polymer, the ratio is 1.3 or more, preferably 1.5 or more. When the base particle has these ratios of relative areal intensities, the base particle can be said to have a localized structure.

In other words, the structural features of the base particle of the present invention in which the contents of the water-soluble salts such as sodium carbonate and sodium sulfate and the water-soluble polymer such as sodium polyacrylate are relatively larger in a portion near the surface thereof, and the content of the water-insoluble inorganic compound such as zeolite is relatively larger in the inner portion of the base particle can be confirmed by the measurement of FT-IR/PAS.

The base particle retaining the original state or in a uniformly ground state is measured by FT-IR/PAS, and the results standardized with the peak intensity of the zeolite are illustrated in FIG. 1. It is clear from FIG. 1 that the relative areal intensity of sodium carbonate and sodium sulfate to the zeolite and the relative areal intensity of sodium polyacrylate to the zeolite, when measured in the state in which the base particle retains the original state, are higher than each of the relative areal intensity when measured in the state in which the base particle is ground to give a uniform state. Incidentally, as the base particle illustrated in FIG. 1, Base Particle 1 of the inventive product described in Examples set forth below is used.

As other examples of the method of structural analysis of the base particle, there can be employed energy dispersion-type X-ray spectroscopy (EDS) and electron probe microanalysis (EPMA). By these analysis methods, two-dimensional distribution of elements can be analyzed by scanning the sample surface with an electron beam.

For instance, as the energy dispersion-type X-ray diffractometer, there can be employed "EMAX 3770" manufactured by Horiba, LTD. which is attached to SEM such as a field emission scanning electron microscope "Model S-4000," manufactured by Hitachi, Ltd. In the case where the water-soluble salts, the water-insoluble inorganic compound, and the water-soluble polymer are contained in the base particle, the distribution state of elements measured with respect to C, O, Na, Al, Si, S, and the like of the split cross section of the base particle obtained by embedding the base particle with a resin and splitting the embedded particle with a microtome, is such that Na and S are present in large amounts in the outer side of the particle cross section, and that Al and Si are present in large amounts in the central portion. Therefore, there can be confirmed the structure of the base particle in which large amounts of the water-soluble salts are included near the surface of the base particle, and a large amount of the water-insoluble inorganic compound is included in the central portion.

FIGS. 2 to 6 each shows an SEM image of the base particle used in the present invention and EDS measurement results for Na, Al, Si and S. Incidentally, the illustrated base particle is Base Particle 1 of Examples.

It is clear from FIGS. 3 to 6 that in the base particle, large proportions of Na and S, the characteristic constituting elements for sodium carbonate and sodium sulfate, which are the water-soluble salts, are distributed near the surface of the particle (near the outer peripheral surface in the particle cross section), and that large proportions of Al and Si, the characteristic constituting elements of zeolite, which are the water-insoluble inorganic compound, are distributed in the central portion of the particle. In FIGS. 3 to 6, portions containing large distribution of each of these elements have high brightness.

4. Detergent Particles Comprising Uni-Core Detergent Particle, and Base Particle It is preferable that the detergent particles of the present invention comprise a uni-core detergent particle from the viewpoint of high-speed dissolubility. The term "uni-core detergent particle" refers to a detergent particle comprising a base particle and a surfactant supported thereby, which refers to a detergent particle wherein a single detergent particle has one base particle as a core.

As an index for expressing the uni-core property, the degree of particle growth as defined in Equation (2):

$$\text{Degree of Particle Growth} = \frac{\text{Average Particle Size of Final Detergent Particles}}{\text{Average Particle Size of Base Particles}} \quad (2)$$

can be employed. The degree of particle growth is preferably 1.5 or less, more preferably 1.3 or less.

The term "final detergent particles" refers to an average particle size of the detergent particles obtained after supporting a surfactant to base particles, or the detergent particles in which the resulting particles are subjected to surface improvement treatment.

In the present invention, the surfactant to be supported by the base particle may be one or a combination of anionic surfactants, nonionic surfactants, amphoteric surfactants, and cationic surfactants, with a preference given to an anionic surfactant and a nonionic surfactant.

The anionic surfactant is preferably salts of esters obtained from an alcohol having 10 to 18 carbon atoms and sulfuric acid; salts of esters obtained from an alkoxylated product of an alcohol having 8 to 20 carbon atoms and sulfuric acid; alkylbenzenesulfonates; paraffinsulfonates; α-olefinsulfonates; salts of α-sulfonated fatty acids; salts of alkyl esters of α-sulfonated fatty acids; and salts of fatty acids. Particularly in the present invention, the linear alkylbenzenesulfonates of which an alkyl moiety has 10 to 14 carbon atoms, more preferably 12 to 14 carbon atoms, are preferable. As the counter ions, a preference is given to the alkali metals and amines, and particularly sodium and/or potassium, monoethanolamine, and diethanolamine are preferable.

Preferable examples of the nonionic surfactant include preferably polyoxyalkylene alkyl (8 to 20 carbon atoms) ethers, alkylene polyglycosides, polyoxyalkylene alkyl(8 to 20 carbon atoms)phenyl ethers, polyoxyalkylene sorbitan fatty acid (8 to 22 carbon atoms) esters, polyoxyalkylene glycol fatty acid (8 to 22 carbon atoms) esters, polyoxyethylene polyoxypropylene block polymers, and polyoxyalkylene alkylol(8 to 22 carbon atoms)amides represented by the following formula (III):

(III)

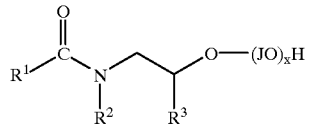

wherein $R^1$ is a saturated or unsaturated hydrocarbon group having an average number of carbon atoms of 7 to 19; each of $R^2$ and $R^3$ is independently H or methyl group; JO is an oxyalkylene group, which is oxyethylene group, oxypropylene group, or a mixture thereof; x is an average additional molar number of the oxyalkylene group, wherein x satisfies $0.5 \leqq x \leqq 10$.

Particularly, the polyoxyalkylene alkyl ether preparing by adding an alkylene oxide such as ethylene oxide or propylene oxide to an alcohol having 10 to 18 carbon atoms in an amount of 4 to 20 moles is preferable as the nonionic surfactant, wherein the resulting polyoxyalkylene alkyl ether has an HLB value as calculated by Griffin method of from 10.5 to 15.0, preferably from 11.0 to 14.5. Also preferable as the nonionic surfactant is a polyoxyalkylene alkylolamide represented by the formula (III), where $R^1$ is a saturated hydrocarbon group having an average number of carbon atoms 11 to 13, each of $R^2$ and $R^3$ is H substituent, and x satisfies $1 \leqq x \leqq 5$.

The amount of the surfactant supported by the base particles used in the present invention is preferably from 5 to 80 parts by weight, more preferably from 5 to 60 parts by weight, still more preferably from 10 to 60 parts by weight, particularly preferably from 20 to 60 parts by weight, based on 100 parts by weight of the base particles, from the viewpoint of exhibiting detergency. Here, the supporting amount of the anionic surfactant is preferably from 1 to 60 parts by weight, more preferably from 1 to 50 parts by weight, still more preferably from 3 to 40 parts by weight. The supporting amount of the nonionic surfactant is preferably from 1 to 45 parts by weight, more preferably from 1 to 35 parts by weight, and preferably from 4 to 25 parts by weight. The anionic surfactant and the nonionic surfactant can be used alone, or they can be preferably used as a mixture. In addition, the amphoteric surfactant or the cationic surfactant may be also used together therewith according to its purpose. The term "supporting amount of the surfactant" used herein does not include the amount of the surfactant added when a surfactant is added in the preparation of slurry in Step (a) of Section 5.1 described below.

The favorable properties for the base particles used in the present invention are as follows.

4.1 Properties of Base Particles 4.1.1 Bulk density: from 400 to 1,000 g/liter, preferably from 500 to 800 g/liter. The bulk density is measured by a method according to JIS K 3362. In the above range, the detergent particles having a bulk density of 500 g/liter or more and excellent high-speed dissolubility can be obtained.

4.1.2 Average particle size: from 150 to 500 $\mu$m, preferably from 180 to 300 $\mu$m. The average particle size is measured by vibrating each of standard sieves (sieve openings: 2000 to 125 $\mu$m) according to JIS Z 8801 for 5 minutes, and calculating a median size from a weight percentage depending upon the size openings of the sieves.

4.1.3 Particle strength: Ranging from 50 to 2,000 kg/cm$^2$, preferably from 100 to 1,500 kg/cm$^2$, particularly preferably from 150 to 1,000 kg/cm$^2$. In the above range, the base particles show excellent breakdown property, so that the detergent particles having excellent high-speed dissolubility can be obtained.

The particle strength is measured by the following method.

A cylindrical vessel of an inner diameter of 3 cm and a height of 8 cm is charged with 20 g of a sample, and the sample-containing vessel (manufactured by Tsutsui Rikagaku Kikai K.K., "Model TVP1" tapping-type close-packed bulk density measurement device; tapping conditions: 36 times/minute, free flow from a height of 60 mm) is tapped for 30 times. The sample height (an initial sample height) after tapping is measured. Thereafter, an entire upper surface of the sample kept in the vessel is pressed at a rate of 10 mm/min with a pressing machine to take measurements for a load-displacement curve. The slope of the linear portion at a displacement rate of 5% or less is multiplied by an initial sample height, and the resulting product is divided by a pressed area, to give a quotient which is defined as particle strength.

4.1.4 Supporting ability: 20 ml/100 g or more, preferably 40 ml/100 g or more. In the above range, the agglomeration of the base particle with each other can be suppressed, so that the uni-core property of the particle in the detergent particles can be favorably maintained.

The supporting ability is measured by the following method.

A cylindrical mixing vessel of an inner diameter of about 5 cm and a height of about 15 cm which is equipped with agitation impellers in the inner portion thereof is charged with 100 g of a sample. With stirring the contents at 350 rpm, linseed oil is supplied at a rate of about 10 ml/min at 25° C. The supporting ability is defined as an amount of linseed oil supplied when the agitation torque reaches the highest level.

4.1.5 Water content: The water content is 20% by weight or less, preferably 10% by weight or less, particularly preferably 5% by weight or less. In this range, the base particles having excellent properties can be obtained.

The water content is measured by the following method.

A three-gram sample is placed on a weighing dish, and the sample is dried with an electric dryer at 105° C. for 2 hours. The sample after drying is weighed. The water content is calculated from the weight loss, namely the difference of the weight before and after drying, which the water content is expressed in percentage.

4.2 Properties of Detergent Particles Comprising Uni-Core Detergent Particle 4.2.1 Uni-Core Property The uni-core property can be confirmed by at least one method selected from Method (a), Method (b), and Method (c).

Figure 7:
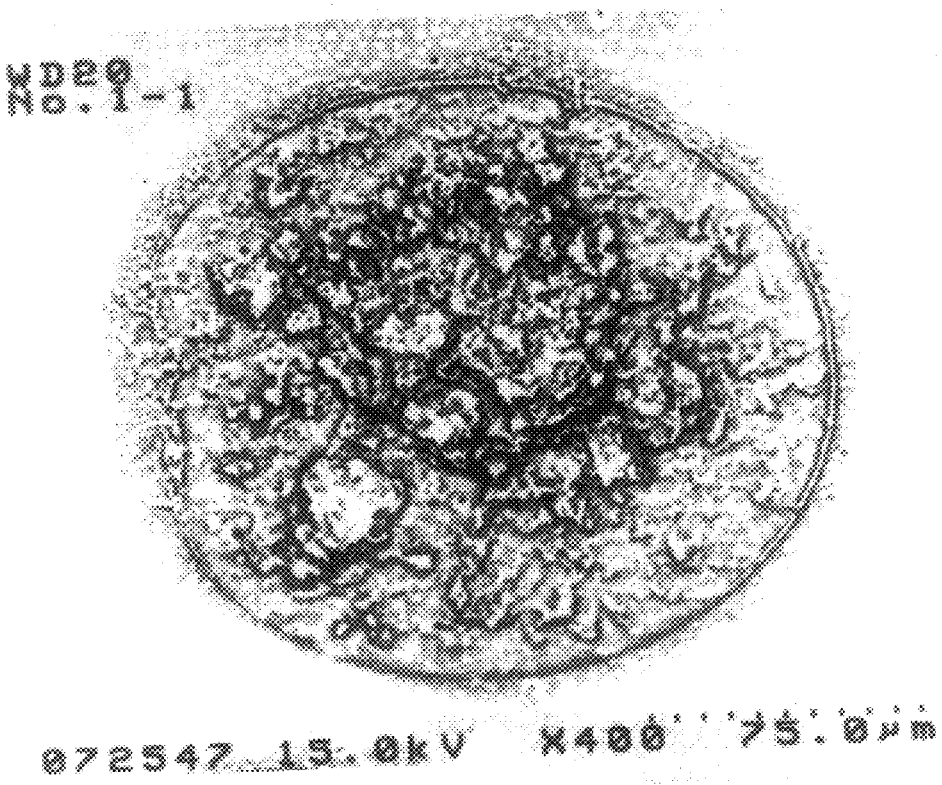
FIG. 7 is a photograph showing one example of a particle structure (magnification: ×400) of the uni-core detergent particle in the detergent particles of Example 1 by SEM photograph.

Method (a): A method of confirming the uni-core property of the detergent particle by splitting some of the detergent particle arbitrarily sampled from the detergent particles of a size near its average particle size, and observing presence or absence of the base particle and a number of the base particle in the detergent particle by a scanning electron microscope (SEM). The SEM photograph illustrated in FIG. 7 is an SEM image observed on the split cross section of the detergent particle prepared from Base Particle 1 of the present invention described in Examples which are set forth below. It is clear from FIG. 7 that the detergent particle contained in the detergent particles of the present invention is a uni-core detergent particle comprising one base particle as a core.

Method (b): A method of observing by SEM observation an organic solvent-insoluble component obtained after extracting an organic solvent-soluble component in the detergent particle with an organic solvent in which the water-soluble polymer in the base particle in the detergent does not dissolve [for instance, in a case where a polyacrylate is present as a water-soluble polymer, and an anionic surfactant (LAS) or a nonionic surfactant is present as a surfactant in the base particle, ethanol can be favorably used.]. Specifically, in a case where one base particle is present in the organic solvent-insoluble component obtained by treating one detergent particle with the above organic solvent, it is found that the detergent particle has uni-core property.

Method (c): A method of confirming the uni-core property of the detergent particle by detecting by means of EDS or EPMA a two-dimensional elementary distribution of the split cross section of the detergent particle embedded by the resin.

4.2.2 High-Speed Dissolubility

The detergent particles comprising the uni-core detergent particle of the present invention have high-speed dissolubility. In the present invention, the +high-speed dissolubility of the uni-core detergent particle can be evaluated by 60-seconds dissolution rate or 30-seconds dissolution rate.

The term "high-speed dissolubility" in 60-seconds dissolution rate of the detergent particles in the present invention refers to a dissolution rate of the detergent particles as calculated by the following method of 90% or more. The dissolution rate is preferably 94% or more, more preferably 97% or more.

The test stirring conditions described above are more concretely detailed below. A one-liter beaker (a cylindrical form having an inner diameter of 105 mm and a height of 150 mm, for instance, a one-liter glass beaker manufactured by Iwaki Glass Co., Ltd.) is charged with one-liter of hard water cooled to 5° C. and having a water hardness corresponding to 71.2 mg $CaCO_3$/liter (a molar ratio of Ca/Mg: 7/3). With keeping the water temperature constant at 5° C. with a water bath, water is stirred with a stirring bar [35 mm in length and 8 mm in diameter, for instance, Model "TEFLON SA" (MARUGATA-HOSOGATA) manufactured by ADVANTEC] at a rotational speed (800 rpm), such that a depth of swirling to the water depth is about ⅓. The detergent particles accurately being sample-reduced and weighed so as to be 1.0000±0.0010 g are supplied and dispersed in water with stirring, and stirring is continued. After 60 seconds from supplying the detergent particles, a liquid dispersion of the detergent particles in the beaker is filtered with a standard sieve (100 mm in diameter) and a sieve-opening of 74 μm as defined by JIS Z 8801 of a known weight. Thereafter, water-containing detergent particles remaining on the sieve are collected in an open vessel of a known weight together with the sieve. Incidentally, the operation time from the start of filtration to collection with the sieve is set at 10 sec±2 sec. The remaining insolubles of the collected detergent particles are dried for one hour in an electric dryer heated to 105° C. Thereafter, the dried insolubles are cooled by keeping in a desiccator with a silica gel at 25° C. for 30 minutes. After cooling the remaining insolubles, a total weight of the dried remaining insolubles of the detergent, the sieve and the collected vessel is measured, and the dissolution rate (%) of the detergent particles is calculated by Equation (1).

The term "high-speed dissolubility" in 30-seconds dissolution rate of the detergent particles in the present invention refers to a dissolution rate of the detergent particles of 82% or more, as calculated by a similar method as the method of calculating 60-seconds dissolution rate wherein a liquid dispersion of the detergent particle is filtered after 30 seconds from supplying the detergent particles. The dissolution rate is preferably 85% or more, more preferably 90% or more.

Even in the above evaluation method using a low-temperature water wherein the dissolution rate of the detergent is lowered, in the present invention, the detergent particles comprising a uni-core detergent particle using a base particle have the high dissolution rate mentioned above. The excellent dissolubility in the present invention provides not only an effect of improving detergency by more speedily eluting the deterging components into a wash tub, but also major advantages in quality in which there are no remaining insolubles of detergents even when washing in a short period of time or with low mechanical strength such as a hand-washing cycle, a gentle cycle, and a quick cycle employed in fully automatic washing machines used today.

The favorable properties for the detergent particles comprising the uni-core detergent particle obtained in the present invention are as follows.

4.2.3 Bulk density: 500 g/liter or more, preferably from 500 to 1,000 g/liter, more preferably from 600 to 1,000 g/liter, still more preferably from 650 to 850 g/liter. The bulk density is measured by a method according to JIS K 3362.

4.2.4 Average particle size: from 150 to 500 μm, preferably from 180 to 300 μm. The average particle size is measured by vibrating each of standard sieves (sieve openings: 2,000 to 125 μm) according to JIS Z 8801 for 5 minutes, and calculating a median size from a weight percentage depending upon the size of sieve openings.

4.2.5 Flowability: evaluated as flow time of preferably 10 seconds or shorter, more preferably 8 seconds or shorter. The flow time is a time period required for dropping 100 ml of powder from a hopper used in a measurement of bulk density as defined in JIS K 3362.

4.2.6 Caking property: evaluated as sieve permeability of preferably 90% or more, more preferably 95% or more.

The testing method for caking property is as follows. A lidless box having dimensions of 10.2 cm in length, 6.2 cm in width, and 4 cm in height is made out of a filter paper (No. 2, manufactured by ADVANTEC) by stapling the filter paper at four corners. A 50 g sample is placed in this box, and an acrylic resin plate and a lead plate (or an iron plate) with a total weight of 15 g+250 g are placed on the sample. The above box is maintained in a thermostat kept at a constant humidity under conditions of a temperature of 30° C. and a humidity of 80%, the caking conditions after 7 days and after one month are evaluated by calculating the permeability as explained below.

Permeability

A sample obtained after the above test is gently placed on a sieve (sieve opening: 4760 μm, as defined by JIS Z 8801), and the weight of the powder passing through the sieve is measured. The permeability based on the sample obtained after the above test is calculated by the following equation:

$$\text{Permeability (\%)} = \frac{\text{Weight of Powder Passing Through Sieve (g)}}{\text{Weight of Entire Sample (g)}} \times 100$$

4.2.7 Exudation property: In the following evaluation, it is preferably 2 rank or better, more preferably 1 rank.

The testing method for exudation property is carried out by evaluation by a visual examination of exudation conditions of a surfactant at a bottom portion of the filter paper obtained after the caking test, the examination being made from a side where the powder is not contacted therewith. The evaluation for exudation property is made based on the area of wetted portion occupying the bottom portion in 1 to 5 ranks. Incidentally, each of the ranks is determined as follows:

Rank 1: Not wetted.

2: About one-quarter of the bottom area being wetted.

3: About one-half the bottom area being wetted.

4: About three-quarter of the bottom area being wetted.

5: The entire bottom area being wetted.

5. Method for Preparing Detergent Particles

The detergent particles of the present invention can be prepared by a method comprising the following Step (a) to Step (c):

Step (a): preparing a slurry containing a water-insoluble inorganic compound, a water-soluble polymer, and a water-soluble salt, wherein 60% by weight or more of water-soluble components comprising the water-soluble polymer and the water-soluble salt is dissolved in the slurry;

Step (b): spray-drying the slurry obtained in Step (a) to prepare base particles; and Step (c): adding a surfactant to the base particles obtained in Step (b) to support the surfactant thereby.

Moreover, in order to further improve the properties and quality of the resulting detergent particles, it is preferable to further add a surface-modifying step subsequent to Step (c). Preferred embodiments for each of Steps (a) to (c) and a surface-modifying step will be described below.

5.1 Step (a) (Step for Preparation of Slurry)

Step (a) comprises preparing a slurry in order to prepare base particles. The slurry used in the present invention may be preferably a slurry having a non-setting property which can be conveyed with a pump. Also, the addition method of the components and their order can be appropriately varied depending upon the preparation conditions. It is preferable that the content of the water-insoluble component (A) in the slurry is from 6 to 63% by weight, and the content of the water-soluble components (B, C) in the slurry is from 2.1 to 56% by weight.

In order that the base particle constituting the base particles obtained in Step (b) has the structure in the present invention, that is the structure in which larger amounts of the water-soluble components (B, C) are present near the surface of the base particle than the inner portion thereof, and larger amounts of the water-insoluble component (A) are present in the inner portion of the base particle than near the surface thereof (localized structure of components), the water-soluble components (B, C) in Step (b) are required to be migrated to the particle surface along with evaporation of moisture. In such case, the dissolution rate of the water-soluble components (B, C) in the slurry becomes an important factor. In other words, it is required to prepare a slurry in which the water-soluble components (B, C) are dissolved in an amount of 60% by weight or more, preferably 70% by weight or more, more preferably 85% by weight or more, still more preferably 90% by weight or more. In general, the water content required for preparing such a slurry is preferably from 30 to 70% by weight, more preferably from 35 to 60% by weight, most preferably from 40 to 55% by weight. When the water content is low, the water-soluble components (B, C) cannot be sufficiently dissolved in the slurry, and thereby the proportions of the water-soluble components (B, C) which are present near the surface of the resulting base particle are decreased. In addition, when the water content is too high, the water content needed to be evaporated in Step (b) becomes high, thereby lowering its productivity.

The measurement method of the dissolution rate of the water-soluble components (water-soluble polymer and water-soluble salts) in the slurry is as follows. The slurry is filtered under reduced pressure, and the water concentration (P %) in the filtrate is measured. The water content of the slurry is denoted as (Q %), and the concentration of the water-soluble components in the slurry is denoted as "R %." The dissolution rate of the water-soluble components is calculated by Equation (3):

$$\text{Dissolution Rate } (\%) = \frac{Q(100-P)}{P} \times \frac{1}{R} \times 100 \quad (3)$$

Here, when the calculated dissolution rate exceeds 100%, the dissolution rate is assumed to be 100%.

Also, the temperature of the slurry is preferably from 30° to 80° C., more preferably from 40° to 70° C. When the temperature of the slurry is in the above range, it is preferable from the aspects of the dissolubility of the water-soluble components (B, C) and the liquid conveyability thereof with a pump.

A method for forming a slurry includes, for instance, a process comprising adding an entire amount or almost the entire amount of water to a mixing vessel at first, and in order or simultaneously adding the remaining components, preferably after a stage where a water temperature almost reaches an operable temperature. The usual order of addition comprises firstly adding liquid components such as a surfactant and a polyacrylate, and subsequently adding a water-soluble, powdery starting material such as soda ash. In addition, a small amount of the auxiliary components such as a dye is added. Finally, the water-insoluble component such as zeolite is added. At this time, for the purpose of improving blending efficiency, the water-insoluble component may be added in two or more separate portions. Also, the powdery starting materials may be previously blended, and the blended powder starting materials may then be added to an aqueous medium. Further, after the addition of the entire components, water may be added to adjust its viscosity or the water content of the slurry. After the addition of the entire components in the slurry, the components are blended for preferably 10 minutes or more, more preferably 30 minutes or more, to prepare a uniform slurry.

5.2 Step (b) (Step for Preparation of Base Particles)

Step (b) comprises drying the slurry obtained in Step (a) to prepare base particles. As the drying method of the slurry, in order to allow the base particle to have pores capable of releasing a bubble of a desired size and also allow the base particle to have the localized structure of the components which are characteristic to the present invention, it is preferable that the slurry is instantaneously dried, and more preferably that spray-drying to form the resulting particle with a substantially spherical shape. The spray-drying tower may be either a countercurrent tower or concurrent tower, and the countercurrent tower is more preferable from the viewpoints of thermal efficiency and improvement in the particle strength of the base particles. The atomization device for the slurry may have any shapes of a pressure spray nozzle, a two-fluid spray nozzle, and a rotary wheel. From the viewpoint of having an average particle size of the resulting base particles of from 150 to 500 $\mu$m, preferably from 180 to 300 $\mu$m, the pressure spray nozzle is particularly preferable.

It is preferable that the temperature of the high-temperature gas supplied to the drying tower is usually from 150° to 300° C., more preferably from 170° to 250° C. When the temperature is higher than the above range, organic compounds in the solid product deposited to the spray-drying tower is likely to be combusted when continuous operation is carried out, which can cause troubles. In addition, it is preferable that the temperature of the gas exhausted from the drying tower is usually from 70° to 125° C., more preferably from 80° to 115° C. When the temperature of the exhaust gas is higher than the above range, the thermal efficiency of the drying tower is lowered.

5.3 Step (c) (Step of Supporting Surfactant)

Step (c) comprises supporting a surfactant to the base particles obtained in Step (b). The surfactant can be supported by the base particles by using known mixers in a batch process or continuous process. Also, in a case where the method of the present invention is carried out in a batch process, the method for supplying the base particles and the surfactant can be carried out, for instance, by the following various processes. Incidentally, each of the processes (1) to (3) is carried out with operating a mixer.

(1) A process comprising supplying base particles in the mixer in advance; and then adding a surfactant thereto. (2) A process comprising simultaneously supplying each of base particles and a surfactant in the mixer in small amounts at a time. (3) A process comprising supplying a part of base particles in the mixer in advance; and supplying the remaining base particles and a surfactant thereto in small amounts at a time.

Among these processes, item (1) above is particularly preferable. Also, the surfactant is preferably added in a liquid state, and it is more preferable that the surfactant in a liquid state is supplied by spraying.

Of the surfactants which are present in the form of solids or pastes even when heated to a temperature within a practical temperature range, those surfactants can be added to the base particles in the form of a liquid mixture or aqueous solution by dispersing or dissolving the solid or paste-like surfactant in a low-viscosity surfactant, such as a nonionic surfactant, an aqueous solution of a nonionic surfactant or water, to prepare a liquid mixture or aqueous solution of surfactants. By this method, the surfactants which are present in the form of solids or pastes can be easily added to the base particles, thereby making it further advantageous in the preparation of the detergent particles comprising the uni-core detergent particle. The mixing ratio of the low-viscosity surfactant or water to the solid or paste-like surfactant is preferably such that the resulting liquid mixture or aqueous solution has a viscosity in a sprayable range. For instance, as to the case of mixing a polyoxyethylene dodecyl ether and sodium dodecylbenzenesulfonate, the liquid mixture of surfactants which is easily sprayable can be obtained by adjusting its mixing ratio to 1:1.4 or less.

Examples of the method for preparing the above liquid mixture include a method of supplying and mixing a solid or paste-like surfactant to a low-viscosity surfactant or water; or a method of neutralizing an acid precursor of a surfactant with an alkalizing agent (for instance, an aqueous sodium hydroxide or an aqueous potassium hydroxide) in a low-viscosity surfactant or water, to prepare a liquid mixture of surfactants.

In addition, in this Step, an acid precursor of an anionic surfactant can be added before adding a surfactant, simultaneously with adding a surfactant, in the course of adding a surfactant, or after adding a surfactant. By adding the acid precursor of an anionic surfactant, there can be achieved high concentration of the surfactants, control for an oil-absorbing ability of the base particles, and improvements in properties and quality, such as prevention of exudation of the nonionic surfactant and the flowability, of the resulting detergent particles.

Examples of the acid precursor of an anionic surfactant which can be used in the present invention include alkylbenzenesulfonic acids, alkylether or alkenylether sulfuric acids, alkylsulfuric or alkyenylsulfuric acids, α-olefinsulfonic acids, α-sulfonated fatty acids, alkylether or alkenylether carboxylic acids, fatty acids, and the like. It is preferable that the fatty acid is added after adding the surfactant, from the viewpoint of improving flowability of the detergent particles.

The amount of the acid precursor of an anionic surfactant used is preferably from 0.5 to 30 parts by weight, more preferably from 1 to 20 parts, based on 100 parts by weight of the base particles. When the amount of the acid precursor of an anionic surfactant used is in the above range, the uni-core properties of the particle in the detergent particles are likely to be maintained, and thereby the detergent particles show excellent high-speed dissolubility. In addition, as the method for adding the acid precursor of an anionic surfactant, it is preferable that those of a liquid state at an ambient temperature are supplied by spraying, and that those of a solid state at an ambient temperature can be added as a powder, or they may be supplied by spraying after melting the solid. Here, in a case of adding as the powder, it is preferable that the temperature of the detergent particles in the mixer is raised to a point where the powder melts.

Known mixers can be used as devices preferably usable for Step (c) including, for instance, Henschel Mixer (manufactured by Mitsui Miike Machinery Co., Ltd.); High-Speed Mixer (Fukae Powtec Corp.); Vertical Granulator (manufactured by Powrex Corp.); Lödige Mixer (manufactured by Matsuzaka Giken Co., Ltd.); PLOUGH SHARE Mixer (manufactured by PACIFIC MACHINERY & ENGINEERING Co., LTD.); Nauta Mixer (manufactured by Hosokawa Micron Corp.); and the like.

From the viewpoint of preparing detergent particles comprising the uni-core detergent particle, as preferable mixers, those devices less likely to have strong shearing force against the base particle (i.e. those mixers less likely to cause breakdown of the base particle) are preferable, and from the viewpoint of dispersion efficiency of the surfactants, those devices with good mixing efficiency are also preferable. Among the above mixers, a particular preference is given to a mixer containing an agitating shaft arranged along the center line of a horizontal, cylindrical blending vessel and agitating impellers arranged on the agitating shaft, to carry out blending of the powders (horizontal mixers), including Lödige Mixer, PLOUGH SHARE Mixer, and the like.

In addition, those mixers listed above in a continuous process can be also used to support the surfactant by the base particles. Also, as the mixers for a continuous process other than those listed above, there can be used, for instance, Flexo Mix (manufactured by Powrex Corp.); TURBULIZER (manufactured by Hosokawa Micron Corp.), and the like.

In addition, in this Step, when a nonionic surfactant is used, a melting point-elevating agent of the nonionic surfactant, which is a water-soluble nonionic organic compound (hereinafter referred to as "melting point-elevating agent") having a melting point of from 45° to 100° C. and a molecular weight of from 1,000 to 30,000, or an aqueous solution of the melting point-elevating agent can be added before adding a surfactant, simultaneously with adding a surfactant, in the course of adding a surfactant, after adding a surfactant, or previously mixing with a surfactant. By adding the melting point-elevating agent, the caking properties and the exudation property of the surfactants in the detergent particles can be suppressed. Examples of the melting point-elevating agent which can be used in the present invention include polyethylene glycols, polypropylene glycols, polyoxyethylene alkyl ethers, pluronic nonionic surfactants, and the like.

The amount of the melting point-elevating agent used is preferably from 0.5 to 5 parts by weight, more preferably from 0.5 to 3 parts by weight, based on 100 parts by weight of the base particles. The amount is preferably in the above range from the aspects of maintaining the uni-core property of the detergent particle contained in the detergent particles, having high-speed dissolubility, and suppressing the exudation property and the caking properties. As a method for adding the melting point-elevating agent, a method comprising previously mixing a melting point-elevating agent with a surfactant in an arbitrary manner, or a method comprising adding a melting point-elevating agent after adding a surfactant is highly advantageous in suppressing the exudation property and the caking properties of the resulting detergent particles.

As to the temperature within the mixer, it is more preferable that mixing is carried out by heating to a temperature equal to or higher than the melting point of the surfactant.

Here, the temperature to be heated is preferably a temperature higher than the melting point of the surfactant added in order to promote the support of the surfactant, and the practical temperature range is preferably a temperature higher than the melting point by 50° C., more preferably a temperature higher than the melting point by 10° to 30° C. In addition, in a case where an acid precursor of the anionic surfactant is added in this Step, it is more preferable to mix the components after heating to a temperature at which the acid precursor of the anionic surfactant can react.

The mixing time in a batch process and the average retention time in the mixing in a continuous process for obtaining the desired detergent particles are preferably from 1 to 20 minutes, more preferably from 2 to 10 minutes.

In addition, in a case where an aqueous solution of a surfactant or an aqueous solution of a melting point-elevating agent is added, a step of drying excess water contents during mixing and/or after mixing may be included.

A powdery surfactant and/or a powdery builder for detergents can be added before adding a surfactant, simultaneously with adding a surfactant, in the course of adding a surfactant, or after adding a surfactant. By adding the powdery builder, the particle size of the detergent particles can be controlled, and an improvement in detergency can be achieved. Particularly in a case where an acid precursor of the anionic surfactant is added, it is more effective to add a powdery builder showing alkaline property prior to adding the acid precursor from the viewpoint of accelerating the neutralization reaction. Incidentally, the term "powdery builder" mentioned herein refers to an agent for enhancing detergency other than surfactants which is in a powdery form. Concrete examples thereof include base materials showing metal ion capturing ability, such as zeolite and citrates; base materials showing alkalizing ability, such as sodium carbonate and potassium carbonate; base materials showing both metal ion capturing agent and alkalizing ability, such as crystalline silicates; and base materials enhancing ionic strength, such as sodium sulfate.

In addition, crystalline silicates disclosed in Japanese Patent Laid-Open No. 5-279013, column 3, line 17 to column 6, line 24 (in particular, those prepared by a method comprising calcinating and crystallizing at a temperature of 500° to 1000° C. are preferable); Japanese Patent Laid-Open No. 7-89712, column 2, line 45 to column 9, line 34; and Japanese Patent Laid-Open No. 60-227895, page 2, lower right column, line 18 to page 4, upper right column, line 3 (particularly the silicates in Table 2 are preferable) can be used as powdery builders. Here, the alkali metal silicates having an $SiO_2/M_2O$ ratio, wherein M is an alkali metal, of from 0.5 to 3.2, preferably from 1.5 to 2.6, can be favorably used.

The amount of the powdery builder used is preferably from 0.5 to 12 parts by weight, more preferably from 1 to 6 parts by weight, based on 100 parts by weight of the base particles. When the amount of the powdery builder for detergents used is in the above range, the uni-core property of the detergent particle contained in the detergent particles can be maintained, excellent high-speed dissolubility can be obtained, and the particle size can be favorably controlled.

5.4 Surface-Modifying Step

In the present invention, in order to modify the particle surface of the detergent particles in which the surfactant is supported in Step (c), there may be carried out a surface-modifying step comprising adding various surface coating agents described below, such as (1) a fine powder, and (2) liquid materials as embodiments for addition. The surface-modifying step may be carried out in one step, or it may be repeated in two steps.

When the particle surface of the detergent particles of the present invention is coated, since the flowability and the non-caking properties of the detergent particles are likely to be improved, it is preferable to include the surface-modifying step. The devices used in the surface-modifying step are not limited to specified ones, and any of known mixers can be used. It is preferable to use the mixers exemplified in Step (c) above. Each of the surface coating agents will be explained below.

(1) Fine Powder

It is preferable that the average particle size of the primary particle is 10 $\mu$m or less, more preferably from 0.1 to 10 $\mu$m. When the average particle size is in this range, it is favorable from the viewpoints of improvements in the coating ratio of the particle surface of the detergent particles, so that the flowability and the anti-caking property of the detergent particles are improved. The average particle size of the fine powder can be measured by a method utilizing light scattering, for instance, by a particle analyzer (manufactured by Horiba, LTD.), or it may be measured by a microscopic observation. In addition, it is preferable that the fine powder has a high ion exchange capacity or a high alkalizing ability from the aspect of detergency.

The fine powder is desirably aluminosilicates, which may be crystalline or amorphous. Besides the aluminosilicates, inorganic fine powders, such as sodium sulfate, calcium silicate, silicon dioxide, bentonite, talc, clay, amorphous silica derivatives, silicate compounds such as crystalline silicate compounds, and the like are also preferable. In addition, a metal soap and a powdery surfactant (for instance, alkylsulfates) of which primary particles have a size of 0.1 to 10 $\mu$m, and a water-soluble salt can be similarly employed. When the crystalline silicate compound is used, it is preferably used in admixture with fine powder other than the crystalline silicate compound for the purpose of preventing deterioration owing to agglomeration of the crystalline silicates by moisture absorption and $CO_2$-absorption, and the like.

The amount of the fine powder used is preferably from 0.5 to 40 parts by weight, more preferably from 1 to 30 parts by weight, particularly preferably from 2 to 20 parts by weight, based on 100 parts by weight of the detergent particles. When the amount of the fine powder is in the above range, the flowability is improved, thereby giving a good texture to consumers.

(2) Liquid Materials

The liquid materials include water-soluble polymers and fatty acids, which can be added in a state of aqueous solutions or a molten state.

(2-1) Water-Soluble Polymer

Examples of the water-soluble polymer include carboxymethyl cellulose, polyethylene glycols, and polycarboxylates such as sodium polyacrylates and copolymers of acryl acid and maleic acid and salts thereof. The amount of the water-soluble polymer used is preferably from 0.5 to 10 parts by weight, more preferably from 1 to 8 parts by weight, particularly preferably from 2 to 6 parts by weight, based on 100 parts by weight of the detergent particles. When the amount of the water-soluble polymer is in the above range, a powder showing excellent flowability and anti-caking properties can be obtained while the detergent particle contained in the detergent particles can maintain their uni-core property and have excellent high-speed dissolubility.

(2-2) Fatty Acid

Examples of the fatty acid include fatty acids having 10 to 22 carbon atoms. The amount of the fatty acid used is preferably from 0.5 to 5 parts by weight, more preferably from 0.5 to 3 parts by weight, based on 100 parts by weight of the detergent particles comprising the uni-core detergent particle. In a case of those in a solid state at an ambient temperature, it is preferable that they are heated to a temperature showing flowability, and then supplied by spraying.

6. Detergent Particles Comprising Multi-Core Detergent Particle

The detergent particles of the present invention can be constituted by a multi-core detergent particle. The multi-core detergent particle may be those in which the above base particle constituting the uni-core detergent particle described in Section 4. above is agglomerated, or those in which water-soluble salts such as sodium carbonate, and the like used as a core are agglomerated, and it is preferable that the detergent particle is capable of releasing a bubble of a given size. In particular, the use of the base particle constituting the uni-core detergent particle contributes to the localized structure of the base particle, so that the high-speed dissolubility can be further improved. Therefore, as the base particle used herein, the base particle in the uni-core detergent particle described above can be used, and as the surfactant which can be supported by the base particle, the surfactant in the uni-core detergent particle described above can be used. In addition, the multi-core detergent particle can be easily formed by increasing the amount of the surfactant. Incidentally, the dissolution acceleration between the base particle can be enhanced by using a foaming agent such as sodium bicarbonate or a percarbonate.

7. Properties of the Detergent Particles Comprising Multi-Core Detergent Particle The detergent particles of the present invention have high-speed dissolubility. The "high-speed dissolubility of the detergent particles" as defined in the present invention can be confirmed by the method of Section 4.2.2 described above. In addition, the detergent particles of the present invention show similarly high dissolution rate to the detergent particles comprising the uni-core detergent particle, thereby showing a higher high-speed dissolubility than the dissolubility of conventional detergents.

As to the bulk density, the average particle size, the flowability, the caking property, and the exudation property, it is preferable that the multi-core detergent particles have similar properties to those comprising the uni-core detergent particle described in Sections 4.2.3 through 4.2.7 above.

8. Detergent Composition

The detergent composition of the present invention comprises (a) detergent particles each comprising a uni-core detergent particle and/or detergent particles each comprising a multi-core detergent particle; and (b) detergent components separately added, other than Component (a) (for instance, fluorescent dyes, enzymes, perfumes, defoaming agents, bleaching agents, bleaching activators, and the like).

In this case, the detergent composition comprises detergent particles comprising the uni-core detergent particle and/or the multi-core detergent particle of the present invention, in an amount of preferably 50% by weight or more, more preferably 60% by weight or more, still more preferably 80% by weight or more in the detergent composition, thereby making it possible to provide a detergent composition having a further enhanced high-speed dissolubility.

In the above detergent composition, in the process of dissolving the detergent composition in water, the particle constituting the detergent composition which release a bubble from the inner portion of the particle of the size of one-tenth or more the particle size of the particle constituting the detergent composition occupies preferably 30% or more, more preferably 50% or more, still more preferably 80% or more, of the particle constituting the entire detergent composition.

The detergent composition of the present invention has a high-speed dissolubility, and its high-speed dissolubility can be confirmed by the method as described in Section 4.2.2 (in this case, the "detergent particles" should read 'detergent composition').

EXAMPLES

Preparation of Base Particle

Base Particles 1 were prepared by the following procedures.

To a 1 $m^3$-mixing vessel having agitation impellers was added 465 kg of water. After the water temperature reached 55° C., 48 kg of a 50% by weight-aqueous sodium dodecylbenzenesulfonate solution and 135 kg of a 40% by weight-aqueous sodium polyacrylate solution were added thereto. After stirring the mixture for 15 minutes, 120 kg of sodium carbonate, 60 kg of sodium sulfate, 9 kg of sodium sulfite, and 3 kg of a dye were added. After stirring the resulting mixture for additional 15 minutes, 300 kg of zeolite was added thereto, and the obtained mixture was stirred for 30 minutes to give a uniform slurry. The final temperature of this slurry was 58° C. In addition, the water content in this slurry was 50% by weight, and the dissolution rate of the aqueous components (sodium polyacrylate, sodium carbonate, sodium sulfate, and sodium sulfite) was 100%.

Figure 8:
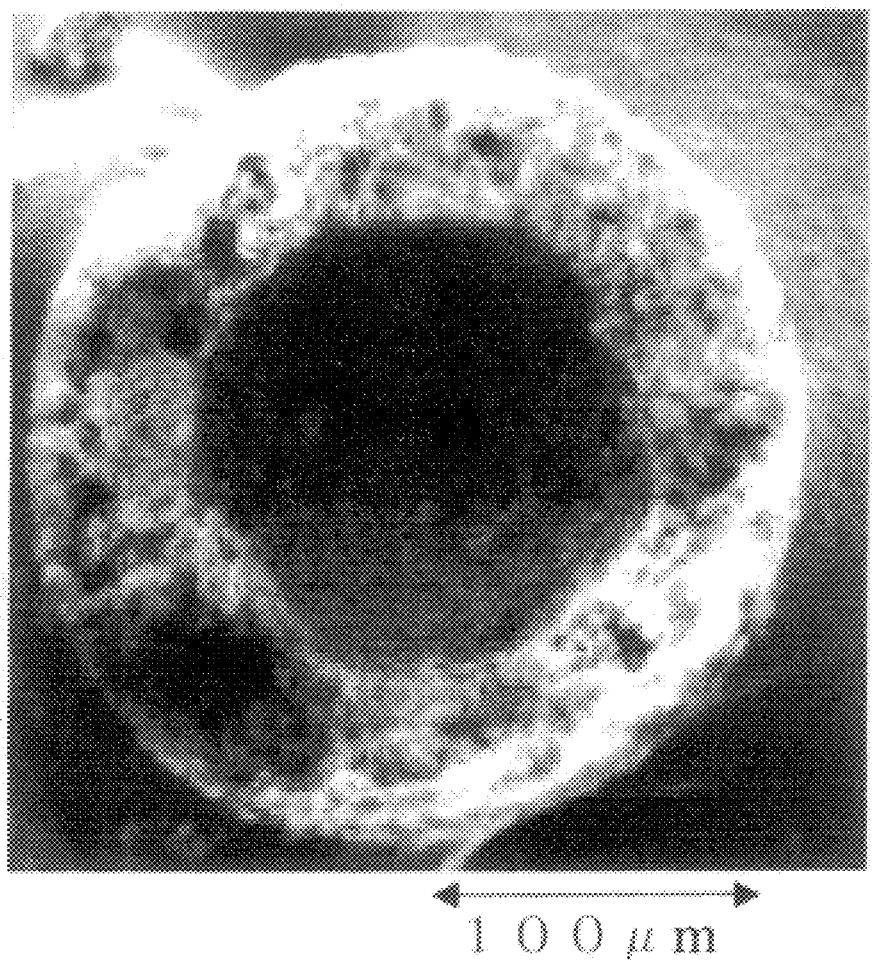
FIG. 8 is a photograph showing one example of a particle structure (magnification: ×400) of Base Particles 1 by SEM photograph.

This slurry was sprayed with a pressure spray nozzle arranged near the top of a spray-drying tower at a spraying pressure of 25 $kg/cm^2$. A high-temperature gas fed to the spray-drying tower was supplied from the lower portion of the tower at a temperature of 225° C. and exhausted from the top of the tower at a temperature of 105° C. The composition of the resulting Base Particles 1 and the properties thereof are shown in Table 1. Also, as to Base Particles 1, an example of an SEM image of a split cross section when measuring the particle size and the pore size of an inner portion of the particle is shown in FIG. 8. Incidentally, with regard to Base Particles 1, it was confirmed that pores with a pore size of from 1/10 to 4/5 the particle size were found in 88% of the particle (Here, an average value for pore size/particle size in the above 88% of the particle was 3.1/5.).

TABLE 1

| | Base Particles | | | |
|---|---|---|---|---|
| | 1 | 2 | 3 | 4 |
| Composition of Base Particles (% by weight) | | | | |
| Component A | | | | |
| Zeolite*1 | 50 | 50 | 67 | 40 |
| Component B | | | | |
| Sodium Polyacrylate*2 | 9 | 9 | 9 | 15 |
| Component C | | | | |
| Sodium Carbonate *3 | 20 | 20 | 17 | 28 |
| Sodium Sulfate | 10 | 10 | — | 10 |
| Sodium Sulfite | 1.5 | 1 | 1 | 1 |
| Others | | | | |
| Sodium Dodecylbenzene-sulfonate*4 | 4 | 4 | — | — |
| Auxiliary Components (Dyes, etc.) *5 | 0.5 | 1 | 1 | 1 |

TABLE 1-continued

| | Base Particles | | | |
|---|---|---|---|---|
| | 1 | 2 | 3 | 4 |
| Water | 5 | 5 | 5 | 5 |
| Slurry Formations | | | | |
| Water Content of Aqueous Slurry (% by wt.) | 50 | 42 | 38 | 54 |
| Dissolution Rate of Water-Soluble Components (% by wt.) | 100 | 90 | 100 | 100 |
| Spray Drying | | | | |
| Gas Supplying Temp. (° C.) | 225 | 227 | 23 | 228 |
| Gas Exhaustion Temp. (° C.) | 105 | 106 | 109 | 108 |
| Spraying Pressure (kg/cm$^2$) | 25 | 25 | 25 | 25 |
| Properties of Base Particles | | | | |
| Bulk Density (g/liter) | 620 | 640 | 720 | 610 |
| Average Particle Size ($\mu$m) | 225 | 235 | 250 | 215 |
| Particle Strength (kg/cm$^2$) | 250 | 320 | 370 | 230 |
| Supporting Ability (ml/100 g) | 52 | 148 | 44 | 65 |
| Water Content (% by weight) | 5 | 3.2 | 3.4 | 3.0 |

Remarks on Table 1:
*1Zeolite 4A-type, average particle size: 3.5 $\mu$m (manufactured by Tosoh Corporation).
*2Average molecular weight: 10000.
*3 "DENSE ASH" (manufactured by Central Glass Co., Ltd.).
*4"NEOPELEX F65" (manufactured by Kao Corporation).
*5 Fluorescent dye "TINOPAL CBS-X" (manufactured by Ciba-Geigy).

Figure 9:
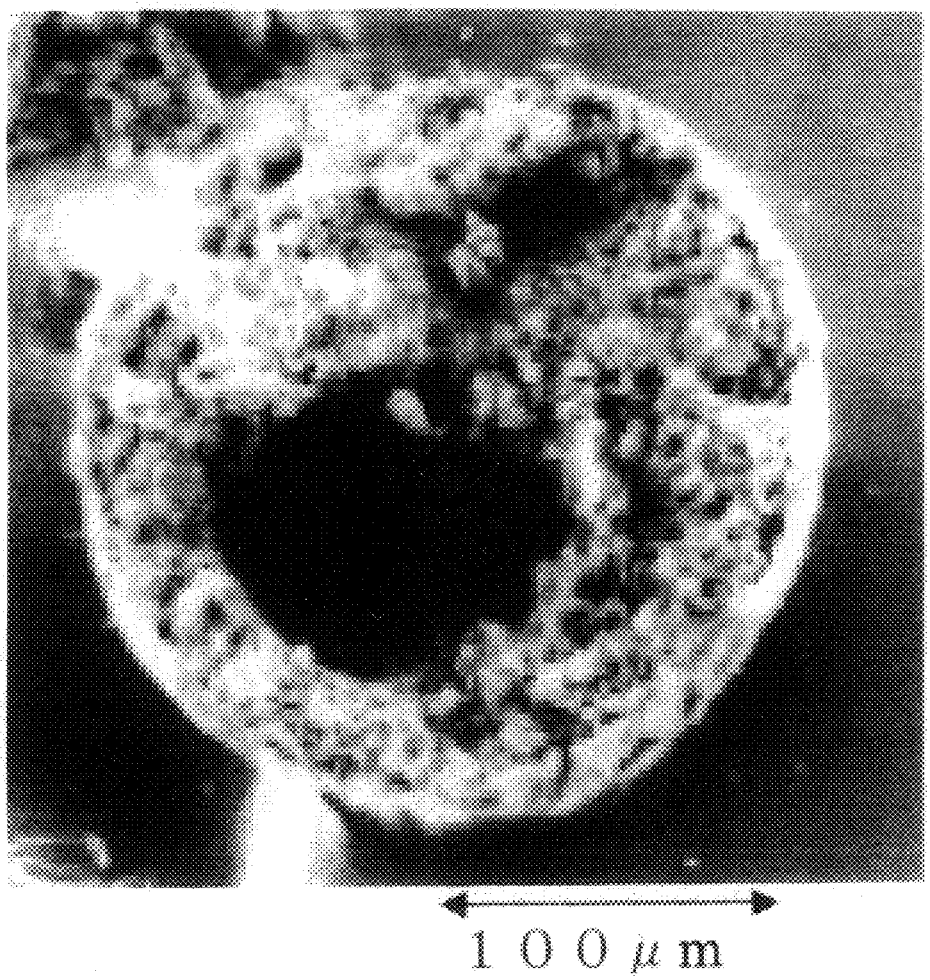
FIG. 9 is a photograph showing one example of a particle structure (magnification: ×400) of Base Particles 2 by SEM photograph.
Figure 10:
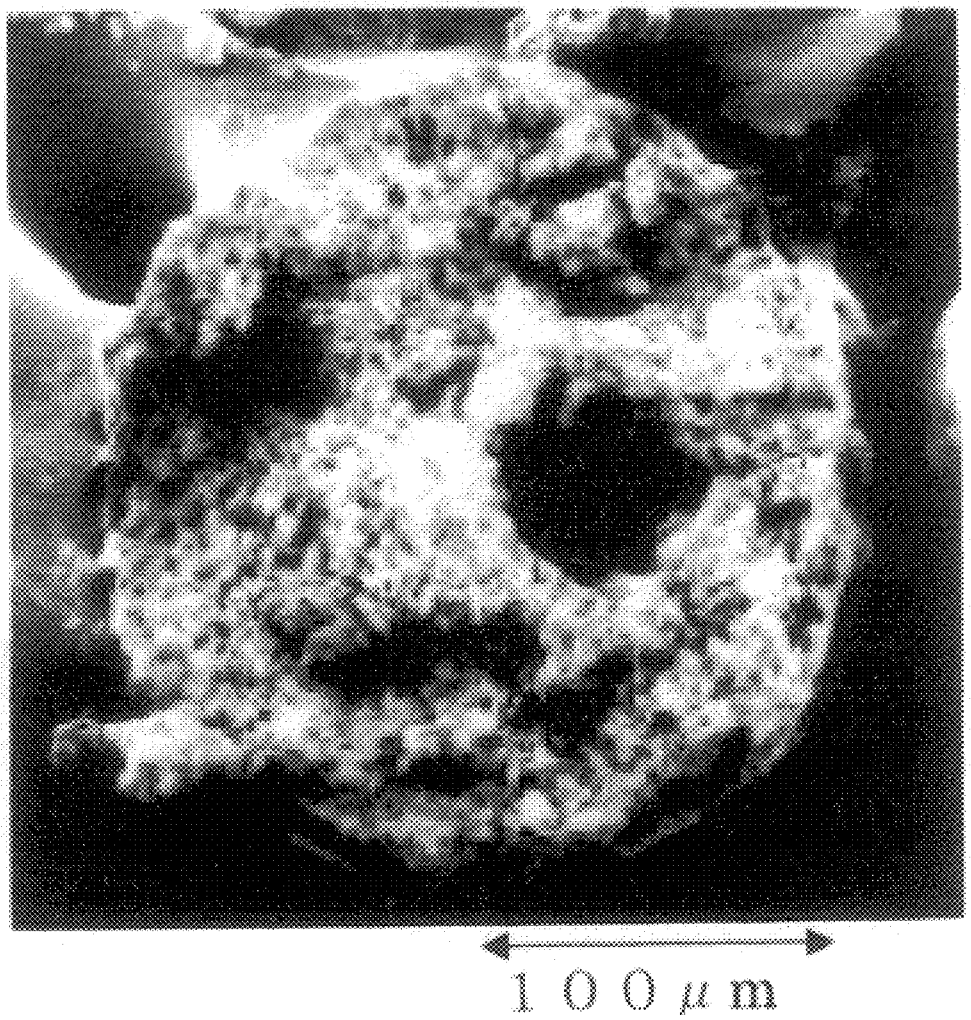
FIG. 10 is a photograph showing one example of a particle structure (magnification: ×400) of Base Particles 3 by SEM photograph.
Figure 11:
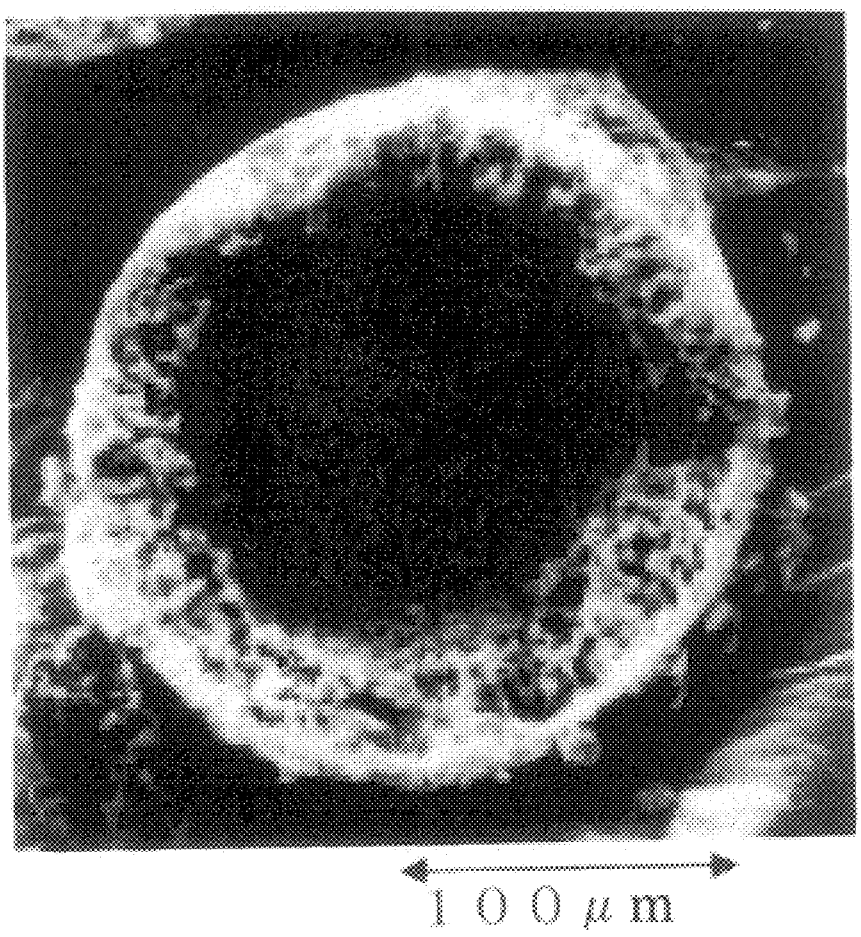
FIG. 11 is a photograph showing one example of a particle structure (magnification: ×400) of Base Particles 4 by SEM photograph.

Base Particles 2 to 4 were prepared in the same manner as above. The composition and the properties of each of Base Particles are shown in Table 1. Also, as to each of Base Particles 2 to 4, examples of SEM images of a split cross section when measuring the particle size and the pore size of an inner portion of the particle are shown in FIGS. 9 to 11. With regard to Base Particles 2, it was confirmed that pores with a pore size of from 1/10 to 4/5 the particle size were found in 85% of the particle (Here, an average value for pore size/particle size in the above 85% of the particle was 2.2/5.). With regard to Base Particles 3, it was confirmed that pores with a pore size of from 1/10 to 4/5 the particle size were found in 91% of the particle (Here, an average value for pore size/particle size in the above 91% of the particle was 1.3/5.). With regard to Base Particles 4, it was confirmed that pores with a pore size of from 1/10 to 4/5 the particle size were found in 72% of the particle (Here, an average value for pore size/particle size in the above 72% of the particle was 3.4/5.).

Also, these base particles were analyzed by FT-IR/PAS, SEM observation, and EDS. As a result, it was confirmed that the base particles had a coating-type particle structure wherein the proportion of the zeolite was high in the inner portion of the particle, and the water-soluble polymer and the water-soluble salts were largely present near the particle surface.

Example 1

The detergent particles of the present invention were obtained by supporting a surfactant to Base Particles 1 in a proportion shown in Table 2. Twenty-three parts by weight of a nonionic surfactant shown in Table 2 were heated to a temperature of 50° C. Next, 100 parts by weight of Base Particles were supplied in Lödige Mixer (manufactured by Matsuzaka Giken Co., Ltd.; capacity: 20 liters; equipped with a jacket), and agitation was initiated with the mixer having a main axis (150 rpm) and a chopper (4,000 rpm). Incidentally, heated water of 60° C. was supplied in the jacket at a flow rate of 10 liters/minute. To the above mixer, the nonionic surfactant was added in a period of 2 minutes, and thereafter the added mixture was agitated for 4 minutes, and the resulting mixture was discharged.

The properties of the resulting detergent particles are shown in Table 2.

TABLE 2

| | Examples | | | | | | |
|---|---|---|---|---|---|---|---|
| | | 1 | 2 | 3 | 4 | 5 | 6 |
| Composition | | | | | | | |
| Base Particles 1 | | 100 | 100 | 100 | 100 | 100 | 100*8 |
| Nonionic Surfactant | | | | | | | |
| Polyoxyethylene Alkyl Ether*1 | | 23 | 21 | 15 | 15 | 20 | 15 |
| Anionic Surfactant | | | | | | | |
| LAS-Na*2 | | — | — | 15 | — | — | 15 |
| Acid Precursor of Anionic Surfactant | | | | | | | |
| LAS-Acid Type*3 | | — | — | — | 15 | — | — |
| Palmitic Acid*4 | | — | — | — | — | 3 | — |
| Melting Point-Elevating Agent of Nonionic Surfactant | | | | | | | |
| Polyethylene Glycol*5 | | — | 2 | 1 | 1 | — | 1 |
| Alkaline Builder | | | | | | | |
| Dense Ash (Pulverized to Average Particle Size of 10 $\mu$m) | | — | — | — | — | 3 | — |
| Surface-Coating Agent (Fine Powder) | | | | | | | |
| Crystalline Aluminosilicate*6 | — | 10 | 10 | 10 | — | 8 | 10 |
| Amorphous Aluminosilicate*7 | — | — | — | — | 5 | — | — |
| Properties | | | | | | | |
| Average Particle Size [$\mu$m] | 230 | 235 | 240 | 240 | 270 | 260 | 255 |

TABLE 2-continued

| | Examples | | | | | | |
|---|---|---|---|---|---|---|---|
| | | 1 | 2 | 3 | 4 | 5 | 6 |
| Degree of Particle Growth | 1.02 | 1.04 | 1.07 | 1.07 | 1.20 | 1.16 | 1.67 |
| Bulk Density (g/liter) | 620 | 640 | 650 | 660 | 680 | 650 | 610 |
| Sixty-Sec. Dissolution Rate [%] | 99 | 99 | 98 | 97 | 97 | 95 | 91 |
| Thirty-Sec. Dissolution Rate [%] | 96 | 96 | 94 | 93 | 90 | 92 | 83 |
| SEM Observation of Split Cross Section | Uni-Core | | | | | | Multi-Core |

Remarks of Table 2:
*1"EMULGEN 108KM," average additional molar number of ethylene oxide: 8.5 [manufactured by Kao Corporation].
*2"NEOPELEX F65" (sodium dodecylbenzenesulfonate) [manufactured by Kao Corporation].
*3"NEOPELEX FS" (dodecylbenzenesulfonic acid) [manufactured by Kao Corporation].
*4"LUNAC P-95" [manufactured by Kao Corporation].
*5"K-PEG 6000," average molecular weight: 8500 [manufactured by Kao Corporation].
*6Zeolite 4A-type, average particle size: 3.5 μm [manufactured by Tosoh Corporation].
*7Product prepared in Preparation Example 2 of Japanese Patent Laid-Open No. 9-132794, average particle size: 8 μm.
*8Particles obtained by classifying and collecting particles sandwiched between a 125 μm-sieve opening and a 180 μm-sieve opening.

All amounts are expressed in parts by weight.

The hollowness of the detergent particles was measured. As a result, it was found that pores with a pore size of 1/10 to 4/5 the particle size were found in 86% of the particle.

Further, the dissolution behavior of the detergent particles was observed by a digital microscope. As a result, it was confirmed that a bubble with a size of 1/10 or more of the particle size was released from 87% of the particle (Here, an average value for size of a released bubble/particle size in the above 87% of the particle was 3.0/5.). Further, the surface of the detergent particles was surface-coated with 10 parts by weight of a crystalline aluminosilicate. The properties of the resulting detergent particles were such that their dissolubility was maintained, and flowability was improved.

Example 2

The detergent particles of the present invention were obtained by adding to Base Particles 1, a nonionic surfactant solution previously mixed with a polyethylene glycol shown in Table 2.

Twenty-one parts by weight of a nonionic surfactant and 2 parts by weight of a polyethylene glycol each shown in Table 2 were heated to a temperature of 70° C., to prepare a liquid mixture. Next, 100 parts by weight of Base Particles were supplied in the same mixer as in Example 1, and agitation was initiated with the mixer having a main axis (150 rpm) and a chopper (4,000 rpm). Incidentally, heated water of 75° C. was supplied in the jacket at a flow rate of 10 liters/minute. To the above mixer, the liquid mixture was added in a period of 2 minutes, and thereafter the added mixture was agitated for 4 minutes. Further, the particle surface of the detergent particles was surface-coated with 10 parts by weight of a crystalline aluminosilicate.

The properties of the resulting detergent particles are shown in Table 2.

Figure 12:
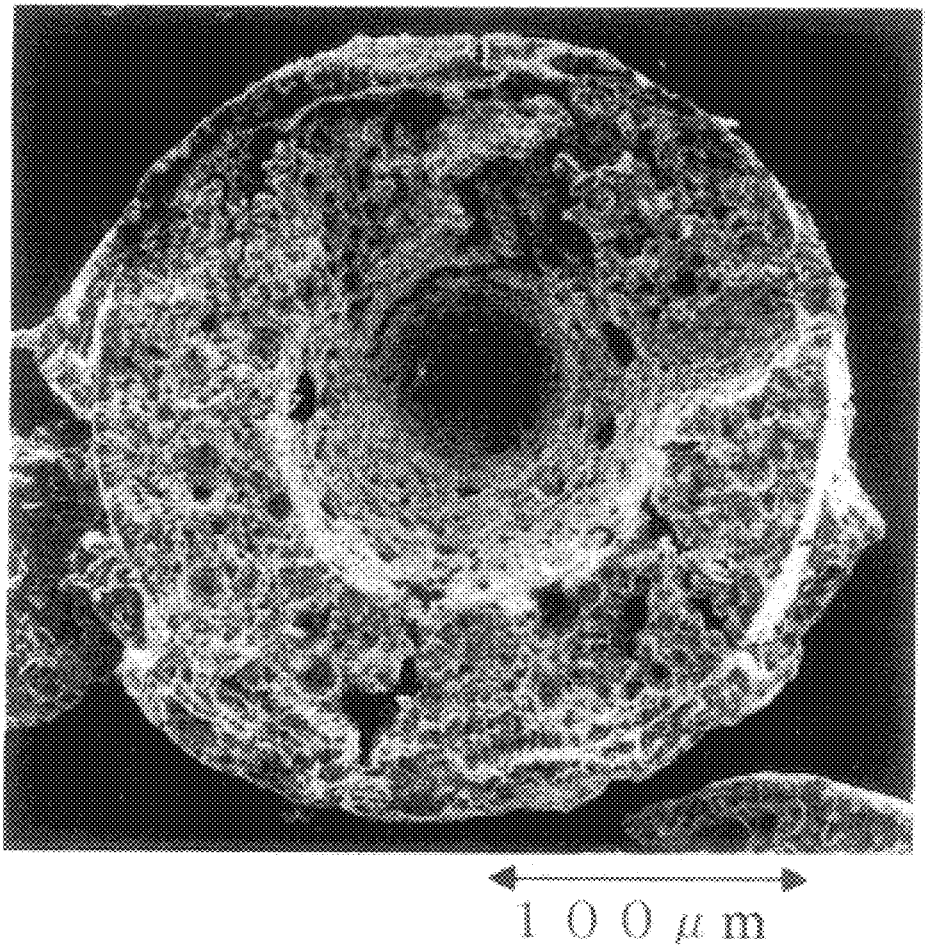
FIG. 12 is a photograph showing one example of a particle structure (magnification: ×400) of the uni-core detergent particle in the detergent particles of Example 2 by SEM photograph.

The hollowness of the detergent particles was measured. As a result, it was found that pores with a pore size of 1/10 to 4/5 the particle size were found in 87% of the particle. An example of an SEM image of a split cross section when measuring the particle size and the pore size of an inner portion of the particle for the detergent particles is shown in FIG. 12.

Further, the dissolution behavior of the detergent particles was observed in the same manner as in Example 1. As a result, it was confirmed that a bubble with a size of 1/10 or more of the particle size was released from 89% of the particle (Here, an average value for size of a released bubble/particle size in the above 89% of the particle was 2.8/5.). In addition, by including the polyethylene glycol, the anti-caking properties of the detergent particles can be further improved, and the exudation of the nonionic surfactant can be further suppressed.

Example 3

The detergent particles of the present invention were obtained by adding to Base Particles 1, surfactants and other components in proportions shown in Table 2.

Fifteen parts by weight of a nonionic surfactant, 15 parts by weight of an anionic surfactant, and 1 part by weight of a polyethylene glycol each shown in Table 2 were heated to a temperature of 70° C. and mixed, to prepare a liquid mixture. Subsequently, the detergent particles were obtained by the same procedures as in Example 2 except that the liquid mixture was added to the mixer in a period of 3 minutes, and thereafter the added mixture was agitated for 5 minutes.

The properties of the resulting detergent particles are shown in Table 2.

The hollowness of the detergent particles was measured. As a result, it was found that pores with a pore size of 1/10 to 4/5 the particle size were found in 90% of the particle.

Further, the dissolution behavior of the detergent particles was observed in the same manner as in Example 1. As a result, it was confirmed that a bubble with a size of 1/10 or more of the particle size was released from 88% of the particle (Here, an average value for size of a released bubble/particle size in the above 88% of the particle was 2.7/5.).

Example 4

As a method of adding an anionic surfactant, an acid precursor of an anionic surfactant was used in such a manner that a nonionic surfactant was supplied into a mixer without mixing with the acid precursor, and thereafter an acid precursor of an anionic surfactant (dodecylbenzenesulfonic acid) was supplied into the mixer to obtain the detergent particles of the present invention. As the base particles, Base Particles 1 were used.

Fifteen parts by weight of a nonionic surfactant and 1 part by weight of a polyethylene glycol which are shown in Table 3 were heated to a temperature of 70° C. and mixed, to prepare a liquid mixture. Next, 100 parts by weight of Base Particles were supplied in the same mixer as in Example 1, and agitation was initiated with the mixer having a main axis (150 rpm) and a chopper (4,000 rpm). Incidentally, heated water of 75° C. was supplied in the jacket at a flow rate of 10 liters/minute. To the above mixer, the liquid mixture was added in a period of 2 minutes, and thereafter the added mixture was agitated for 3 minutes. Next, 15 parts by weight of an acid precursor of an anionic surfactant heated to 45° C. were supplied in a period of 2 minutes, and thereafter the added mixture was agitated for 4 minutes. Further, the particle surface of the detergent particles was surface-coated with 5 parts by weight of a crystalline aluminosilicate.

The properties of the resulting detergent particles are shown in Table 2.

The hollowness of the detergent particles was measured. As a result, it was found that pores with a pore size of 1/10 to 4/5 the particle size were found in 85% of the particle.

Further, the dissolution behavior of the detergent particles was observed in the same manner as in Example 1. As a result, it was confirmed that a bubble with a size of 1/10 or more of the particle size was released from 86% of the particle (Here, an average value for size of a released bubble/particle size in the above 86% of the particle was 2.8/5.).

Example 5

The detergent particles of the present invention were obtained by adding surfactants and other components to Base Particles 1 in proportions shown in Table 2.

Twenty parts by weight of a nonionic surfactant shown in Table 2 were heated to a temperature of 50° C. Next, 100 parts by weight of Base Particles were supplied in the same mixer as in Example 1, and agitation was initiated with the mixer having a main axis (150 rpm) and a chopper (4,000 rpm). Incidentally, heated water of 75° C. was supplied in the jacket at a flow rate of 10 liters/minute. To the above mixer, the nonionic surfactant was added in a period of 2 minutes, and thereafter the added mixture was agitated for 4 minutes. Next, 3 parts by weight of an alkaline builder shown in Table 2 were supplied therein, and the mixture was agitated for one minute. Thereafter, a molten product of an acid precursor of an anionic surfactant shown in Table 2 at 80° C. was supplied thereinto, and the mixture was agitated for 2 minutes, and the resulting mixture was discharged. Further, the surface of the detergent particles was surface-coated with 8 parts by weight of a crystalline aluminosilicate.

The properties of the resulting detergent particles are shown in Table 2.

The hollowness of the detergent particles was measured. As a result, it was found that pores with a pore size of 1/10 to 4/5 the particle size were found in 86% of the particle.

Further, the dissolution behavior of the detergent particles was observed in the same manner as in Example 1. As a result, it was confirmed that a bubble with a size of 1/10 or more of the particle size was released from 88% of the particle (Here, an average value for size of a released bubble/particle size in the above 88% of the particle was 2.9/5.).

Example 6

The detergent particles were obtained in the same manner as in Example 3 except for using as Base Particles particles classified between 125 μm-sieve opening and 180 μm-sieve opening by sieving Base Particles 1.

The properties of the resulting detergent particle are shown in Table 2.

The split cross section of the detergent particle was observed by SEM. As a result, it was confirmed that the detergent particle had a particle structure of the multi-core detergent particle. Moreover, the dissolution behavior of the detergent particles was observed in the same manner as in Example 1. As a result, it was confirmed that a bubble with a size of 1/10 or more of the particle size was released from 68% of the particle (Here, an average value for size of a released bubble/particle size in the above 68% of the particle was 1.5/10.).

Example 7

The detergent composition of the present invention was obtained by adding the enzyme granules to the detergent particles of Example 3 in a proportion shown in Table 3. The properties of the resulting detergent composition is shown in Table 3.

TABLE 3

| | Example 7 | Example 8 |
|---|---|---|
| Composition | | |
| Detergent Particles | 100 Parts (Example 3) | 100 Parts (Example 6) |
| Enzyme Granules | 4 Parts | 2 Parts |
| Properties | | |
| Average Particle Size [μm] | 245 | 260 |
| Bulk Density [g/liter] | 670 | 620 |
| Sixty-Sec. Dissolution Rate [%] | 96 | 91 |
| Thirty-Sec. Dissolution Rate [%] | 91 | 82 |

Example 8

The detergent composition of the present invention was obtained by adding the enzyme granules to the detergent particles of Example 6 in a proportion shown in Table 3. The properties of the resulting detergent composition is shown in Table 3.

Incidentally, the enzyme in the enzyme granules in Table 3 is "Savinase 18T type W" manufactured by Novo Industry.

INDUSTRIAL APPLICABILITY

According to the present invention, there can be provided detergent particles having high-speed dissolubility and a detergent composition comprising these detergent particles. By the present invention, there can be achieved not only an effect of improving detergency by eluting the detergent components more quickly into a wash tub, but also a remarkable effect in detergency, in which substantially no remaining insolubles of detergents are produced even when washing under a low mechanical power or a short period of time such as hand-washing cycle, gentle stirring cycle, and speed cycle generally employed in fully automatic washing machines today.

What is claimed is:

1. Detergent particles having an average particle size of from 150 to 500 μm and a bulk density of 500 g/liter or more, wherein the detergent particles comprise a detergent particle, which releases a bubble from an inner portion of the detergent particle in a process of dissolving the detergent particle in water, the bubble having a size of one-tenth or more of a particle size of the detergent particle, and wherein the detergent particles have a dissolution rate of 90% or more, under conditions where the detergent particles are supplied in water at 5° C.; stirred for 60 seconds under the stirring conditions that 1 g of the detergent particles is supplied to a one-liter beaker having an inner diameter of 105 mm which is charged with one-liter of hard water having 71.2 mg $CaCO_3$/liter, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 μm, wherein the dissolution rate of the detergent particles is calculated by Equation (1):

$$\text{Dissolution Rate } (\%)=(1-(T/S))\times 100 \quad (1)$$

wherein

S is a weight (g) of the detergent particles supplied; and

T is a dry weight (g) of remaining insolubles of the detergent particles remaining on the sieve when a liquid prepared under the above stirring conditions is filtered with the sieve, wherein drying condition for the remaining insolubles are kept at a temperature of 105° C. for 1 hour, and then in a desiccator with a silica gel at 25° C. for 30 minutes, wherein the detergent particles are a collective of a detergent particle comprising a base particle comprising a water-soluble salt comprising sodium carbonate and 2 to 30% by weight of a water-soluble polymer, and from 5 to 80 parts by weight of a surfactant supported by 100 parts by weight of the base particle, and wherein the detergent particles comprise a detergent particle having pores in the inner portion thereof having a size of one-tenth to four-fifth of the particle size.

2. Detergent particles having an average particle size of from 150 to 500 μm and a bulk density of 500 g/liter or more, wherein the detergent particles comprise a detergent particle which releases a bubble from an inner portion of the detergent particle in a process of dissolving the detergent particle in water, the bubble having a size of one-tenth or more of a particle size of the detergent particle, and wherein the detergent particles have a dissolution rate of 82% or more, under conditions where the detergent particles are supplied in water at 5° C.; stirred for 30 seconds under the stirring conditions that 1 g of the detergent particles is supplied to a one-liter beaker having an inner diameter of 105 mm which is charged with one-liter of hard water having 71.2 mg $CaCO_3$/liter, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 μm, wherein the dissolution rate of the detergent particles is calculated by Equation (1):

$$\text{Dissolution Rate } (\%)=(1-(T/S))\times 100 \quad (1)$$

wherein

S is a weight (g) of the detergent particles supplied; and

T is a dry weight (g) of remaining insolubles of the detergent particles remaining on the sieve when a liquid prepared under the above stirring conditions is filtered with the sieve, wherein drying condition for the remaining insolubles are kept at a temperature of 105° C. for 1 hour, and then in a desiccator with a silica gel at 25° C. for 30 minutes, wherein the detergent particles are a collective of a detergent particle comprising a base particle comprising a water-soluble salt comprising sodium carbonate and 2 to 30% by weight of a water-soluble polymer, and from 5 to 80 parts by weight of a surfactant supported by 100 parts by weight of the base particle, and wherein the detergent particles comprise a detergent particle having pores in the inner portion thereof having a size of one-tenth to four-fifth of the particle size.

3. Detergent particles having an average particle size of from 150 to 500 μm and a bulk density of 500 g/liter or more, wherein the detergent particles comprise a detergent particle which releases a bubble from an inner portion of the detergent particle in a process of dissolving the detergent particle in water, the bubble having a size of one-tenth or more of a particle size of the detergent particle, and wherein the detergent particles have a dissolution rate of 90% or more, under conditions where the detergent particles are supplied in water at 5° C.; stirred for 60 seconds under the stirring conditions that 1 g of the detergent particles is supplied to a one-liter beaker having an inner diameter of 105 mm which is charged with one-liter of hard water having 71.2 mg $CaCO_3$/liter, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 μm, wherein the dissolution rate of the detergent particles is calculated by Equation (1):

$$\text{Dissolution Rate } (\%)=(1-(T/S))\times 100 \quad (1)$$

wherein

S is a weight (g) of the detergent particles supplied; and

T is a dry weight (g) of remaining insolubles of the detergent particles remaining on the sieve when a liquid prepared under the above stirring conditions is filtered with the sieve, wherein drying condition for the remaining insolubles are kept at a temperature of 105° C. for 1 hour, and then in a desiccator with a silica gel at 25° C. for 30 minutes, wherein the detergent particles are a collective of a detergent particle comprising a base particle comprising a water-soluble salt comprising sodium carbonate and 2 to 30% by weight of a water-soluble polymer, and from 5 to 80 parts by weight of a surfactant supported by 100 parts by weight of the base particle, and wherein the base particle has a localized structure in which larger portions of the water-soluble polymer and the water-soluble salt are present near the surface of the base particle rather than in the inner portion thereof.

4. Detergent particles having an average particle size of from 150 to 500 $\mu$m and a bulk density of 500 g/liter or more, wherein the detergent particles comprise a detergent particle which releases a bubble from an inner portion of the detergent particle in a process of dissolving the detergent particle in water, the bubble having a size of one-tenth or more of a particle size of the detergent particle, and wherein the detergent particles have a dissolution rate of 82% or more, under conditions where the detergent particles are supplied in water at 5° C.; stirred for 30 seconds under the stirring conditions that 1 g of the detergent particles is supplied to a one-liter beaker having an inner diameter of 105 mm which is charged with one-liter of hard water having 71.2 mg $CaCO_3$/liter, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 $\mu$m, wherein the dissolution rate of the detergent particles is calculated by Equation (1):

$$\text{Dissolution Rate } (\%)=(1-(T/S))\times 100 \quad (1)$$

wherein

S is a weight (g) of the detergent particles supplied; and

T is a dry weight (g) of remaining insolubles of the detergent particles remaining on the sieve when a liquid prepared under the above stirring conditions is filtered with the sieve, wherein drying condition for the remaining insolubles are kept at a temperature of 105° C. for 1 hour, and then in a desiccator with a silica gel at 25° C. for 30 minutes, wherein the detergent particles are a collective of a detergent particle comprising a base particle comprising a water-soluble salt comprising sodium carbonate and 2 to 30% by weight of a water-soluble polymer, and from 5 to 80 parts by weight of a surfactant supported by 100 parts by weight of the base particle, and wherein the base particle has a localized structure in which larger portions of the water-soluble polymer and the water-soluble salt are present near the surface of the base particle rather than in the inner portion thereof.

5. Detergent particles according to claim 1, wherein the base particle has a localized structure in which larger portions of the water-soluble polymer and the water-soluble salt are present near the surface of the base particle rather than in the inner portion thereof.

6. Detergent particles according to claim 2, wherein the base particle has a localized structure in which larger portions of the water-soluble polymer and the water-soluble salt are present near the surface of the base particle rather than in the inner portion thereof.

7. Detergent particles according to claim 1, wherein said base particle further comprises a water-insoluble inorganic compound.

8. Detergent particles according to claim 2, wherein said base particle further comprises a water-insoluble inorganic compound.

9. Detergent particles according to claim 3, wherein said base particle further comprises a water-insoluble inorganic compound.

10. Detergent particles according to claim 4, wherein said base particle further comprises a water-insoluble inorganic compound.

11. Detergent particles according to claim 5, wherein said base particle further comprises a water-insoluble inorganic compound.

12. Detergent particles according to claim 6, wherein said base particle further comprises a water-insoluble inorganic compound.

13. Detergent particles according to claim 7, wherein the base particle comprises 20 to 90% by weight of the water-insoluble inorganic compound; and 5 to 78% by weight of the water-soluble salt.

14. Detergent particles according to claim 8, wherein the base particle comprises 20 to 90% by weight of the water-insoluble inorganic compound; and 5 to 78% by weight of the water-soluble salt.

15. Detergent particles according to claim 9, wherein the base particle comprises 20–90% by weight of the water-insoluble inorganic compound; and 5 to 78% by weight of the water-soluble salt.

16. Detergent particles according to claim 10, wherein the base particle comprises 20 to 90% by weight of the water-insoluble inorganic compound; and 5 to 78% by weight of the water-soluble salt.

17. Detergent particles according to claim 11, wherein the base particle comprises 20 to 90% by weight of the water-insoluble inorganic compound; and 5 to 78% by weight of the water-soluble salt.

18. Detergent particles according to claim 12, wherein the base particle comprises 20 to 90% by weight of water-insoluble inorganic compound; and 5 to 78% by weight of the water-soluble salt.

19. Detergent particles according to claim 1, wherein the detergent particles comprise an uni-core detergent particle.

20. Detergent particles according to claim 2, wherein the detergent particles comprise an uni-core detergent particle.

21. Detergent particles according to claim 3, wherein the detergent particles comprise an uni-core detergent particle.

22. Detergent particles according to claim 4, wherein the detergent particles comprise an uni-core detergent particle.

23. Detergent particles according to claim 5, wherein the detergent particles comprise an uni-core detergent particle.

24. Detergent particles according to claim 6, wherein the detergent particles comprise an uni-core detergent particle.

25. Detergent particles according to claim 7, wherein the detergent particles comprise an uni-core detergent particle.

26. Detergent particles according to claim 8, wherein the detergent particles comprise an uni-core detergent particle.

27. Detergent particles according to claim 9, wherein the detergent particles comprise an uni-core detergent particle.

28. Detergent particles according to claim 10, wherein the detergent particles comprise an uni-core detergent particle.

29. Detergent particles according to claim 11, wherein the detergent particles comprise an uni-core detergent particle.

30. Detergent particles according to claim 12, wherein the detergent particles comprise an uni-core detergent particle.

31. A method for preparing the detergent particles as defined in any one of claims 1 to 30, comprising the steps of:

Step (a): preparing a slurry containing a water-insoluble inorganic compound, a water-soluble polymer, and a water-soluble salt comprising sodium carbonate, wherein 60% by weight or more of water-soluble components including the water-soluble polymer and the water-soluble salt are dissolved in the slurry;

Step (b): spray-drying the slurry obtained in Step (a) to prepare base particles; and Step (c): adding a surfactant to the base particles obtained in Step (b) to support the surfactant thereby.

32. A detergent composition comprising the detergent particles as defined in any one of claims 1 to 30 in an amount of 50% by weight or more.

33. A detergent composition having an average particle size of from 150 to 500 $\mu$m and a bulk density of 500 g/liter or more, wherein the detergent composition comprises a detergent particle which releases a bubble from an inner portion of the detergent particle in a process of dissolving the detergent particle in water, the bubble having a size of one-tenth or more of a particle size of the detergent particle, and wherein the detergent composition has a dissolution rate of 90% or more, under conditions where the detergent composition is supplied in water at 5° C.; stirred for 60 seconds under the stirring conditions that 1 g of the detergent composition is supplied to a one-liter beaker having an inner diameter of 105 mm which is charged with one-liter of hard water having 71.2 mg $CaCO_3$/liter, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 $\mu$m, wherein the dissolution rate of the detergent composition is calculated by Equation (1):

$$\text{Dissolution Rate } (\%)=(1-(T/S))\times 100 \quad (1)$$

wherein

S is a weight (g) of the detergent composition supplied; and

T is a dry weight (g) of remaining insolubles of the detergent composition remaining on the sieve when a liquid prepared under the above stirring conditions is filtered with the sieve, wherein drying condition for the remaining insolubles are kept at a temperature of 105° C. for 1 hour, and then in a desiccator with a silica gel at 25° C. for 30 minutes, wherein the detergent particle comprises a base particle comprising a water-soluble salt comprising sodium carbonate and 2 to 30% by weight of a water-soluble polymer, and from 5 to 80 parts by weight of a surfactant supported by 100 parts by weight of the base particle, and wherein the detergent composition comprises a detergent particle having pores in the inner portion thereof having a size of one-tenth to four-fifth of the particle size.

34. A detergent composition having an average particle size of from 150 to 500 $\mu$m and a bulk density of 500 g/liter or more, wherein the detergent composition comprises a detergent particle which releases a bubble from an inner portion of the detergent particle in a process of dissolving the detergent particle in water, the bubble having a size of one-tenth or more of a particle size of the detergent particle, and wherein the detergent composition has a dissolution rate of 82% or more, under conditions where the detergent composition is supplied in water at 5° C.; stirred for 30 seconds under the stirring conditions that 1 g of the detergent composition is supplied to a one-liter beaker having an inner diameter of 105 mm which is charged with one-liter of hard water having 71.2 mg $CaCO_3$/liter, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 $\mu$m, wherein the dissolution rate of the detergent composition is calculated by Equation (1):

$$\text{Dissolution Rate } (\%)=(1-(T/S))\times 100 \quad (1)$$

wherein

S is a weight (g) of the detergent composition supplied; and

T is a dry weight (g) of remaining insolubles of the detergent composition remaining on the sieve when a liquid prepared under the above stirring conditions is filtered with the sieve, wherein drying condition for the remaining insolubles are kept at a temperature of 105° C. for 1 hour, and then in a desiccator with a silica gel at 25° C. for 30 minutes, wherein the detergent particle comprises a base particle comprising a water-soluble salt comprising sodium carbonate and 2 to 30% by weight of a water-soluble polymer, and from 5 to 80 parts by weight of a surfactant supported by 100 parts by weight of the base particle, and wherein the detergent composition comprises a detergent particle having pores in the inner portion thereof having a size of one-tenth to four-fifth of the particle size.

35. A detergent composition having an average particle size of from 150 to 500 $\mu$m and a bulk density of 500 g/liter or more, wherein the detergent composition comprises a detergent particle which releases a bubble from an inner portion of the detergent particle in a process of dissolving the detergent particle in water, the bubble having a size of one-tenth or more of a particle size of the detergent particle, and wherein the detergent composition has a dissolution rate of 90% or more, under conditions where the detergent composition is supplied in water at 5° C.; stirred for 60 seconds under the stirring conditions that 1 g of the detergent composition is supplied to a one-liter beaker having an inner diameter of 105 mm which is charged with one-liter of hard water having 71.2 mg $CaCO_3$/liter, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 $\mu$m, wherein the dissolution rate of the detergent composition is calculated by Equation (1):

$$\text{Dissolution Rate } (\%)=(1-(T/S))\times 100 \quad (1)$$

wherein

S is a weight (g) of the detergent composition supplied; and

T is a dry weight (g) of remaining insolubles of the detergent composition remaining on the sieve when a liquid prepared under the above stirring conditions is filtered with the sieve, wherein drying condition for the remaining insolubles are kept at a temperature of 105° C. for 1 hour, and then in a desiccator with a silica gel at 25° C. for 30 minutes, wherein the detergent particle comprises a base particle comprising a water-soluble salt comprising sodium carbonate and 2 to 30% by weight of a water-soluble polymer, and from 5 to 80 parts by weight of a surfactant supported by 100 parts by weight of the base particle, and wherein the base particle has a localized structure in which larger portions of the water-soluble polymer and the water-soluble salt are present near the surface of the base particle rather than in the inner portion thereof.

36. A detergent composition having an average particle size of from 150 to 500 $\mu$m and a bulk density of 500 g/liter or more, wherein the detergent composition comprises a detergent particle which releases a bubble from an inner portion of the detergent particle in a process of dissolving the detergent particle in water, the bubble having a size of one-tenth or more of a particle size of the detergent particle, and wherein the detergent composition has a dissolution rate of 82% or more, under conditions where the detergent composition is supplied in water at 5° C.; stirred for 30 seconds under the stirring conditions that 1 g of the detergent composition is supplied to a one-liter beaker having an inner diameter of 105 mm which is charged with one-liter of hard water having 71.2 mg $CaCO_3$/liter, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 $\mu$m, wherein the dissolution rate of the detergent composition is calculated by Equation (1):

$$\text{Dissolution Rate } (\%)=(1-(T/S))\times 100 \quad (1)$$

wherein

S is a weight (g) of the detergent composition supplied; and

T is a dry weight (g) of remaining insolubles of the detergent composition remaining on the sieve when a liquid prepared under the above stirring conditions is filtered with the sieve, wherein drying condition for the remaining insolubles are kept at a temperature of 105° C. for 1 hour, and then in a desiccator with a silica gel at 25° C. for 30 minutes, wherein the detergent particle comprises a base particle comprising a water-soluble salt comprising sodium carbonate and 2 to 30% by weight of a water-soluble polymer, and from 5 to 80 parts by weight of a surfactant supported by 100 parts by weight of the base particle, and wherein the base particle has a localized structure in which larger portions of the water-soluble polymer and the water-soluble salt are present near the surface of the base particle rather than in the inner portion thereof.

37. The detergent composition according to claim 33, wherein the base particle has a localized structure in which larger portions of the water-soluble polymer and the water-soluble salt are present near the surface of the base particle rather than in the inner portion thereof.

38. The detergent composition according to claim 34, wherein the base particle has a localized structure in which larger portions of the water-soluble polymer and the water-soluble salt are present near the surface of the base particle rather than in the inner portion thereof.

* * * * *